US011719517B2

(12) United States Patent
Green et al.

(10) Patent No.: US 11,719,517 B2
(45) **Date of Patent: *Aug. 8, 2023**

(54) COMPACT ENERGETIC-BREACHING APPARATUS

(71) Applicant: P3D Solutions, Inc., Lafayette, LA (US)

(72) Inventors: Justin Green, Jefferson, LA (US); Eirik Nytro, Uberlingen (DE)

(73) Assignee: P3D SOLUTIONS, INC., Lafayette, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/675,073

(22) Filed: Feb. 18, 2022

(65) Prior Publication Data

US 2022/0170721 A1 Jun. 2, 2022

Related U.S. Application Data

(63) Continuation of application No. 16/906,815, filed on Jun. 19, 2020, now Pat. No. 11,255,646.

(60) Provisional application No. 62/981,296, filed on Feb. 25, 2020, provisional application No. 62/866,988, filed on Jun. 26, 2019.

(51) Int. Cl.

| | |
|---|---|
| ***F42B 1/028*** | (2006.01) |
| ***F42B 3/08*** | (2006.01) |
| ***F42D 3/00*** | (2006.01) |
| *F42B 1/032* | (2006.01) |

(52) U.S. Cl.
CPC ..... *F42B 1/028* (2013.01); *F42B 3/08* (2013.01); *F42D 3/00* (2013.01); *F42B 1/032* (2013.01)

(58) Field of Classification Search
CPC ..... F42D 3/00; F42B 1/028; F42B 3/08
USPC ..... 102/306, 307, 308, 309, 310
See application file for complete search history.

(56) References Cited

U.S. PATENT DOCUMENTS

| | | | | |
|---|---|---|---|---|
| 11,255,646 | B2 * | 2/2022 | Green | F42D 1/22 |
| 2022/0276036 | A1 * | 9/2022 | Sansour | F42D 5/00 |

FOREIGN PATENT DOCUMENTS

| | | | | |
|---|---|---|---|---|
| WO | WO-9920974 | A2 * | 4/1999 | F42B 12/204 |

* cited by examiner

*Primary Examiner* — Bret Hayes
(74) *Attorney, Agent, or Firm* — Stephen H. Hall; Bradley Arant Boult Cummings LLP

(57) ABSTRACT

A compact energetic-breaching apparatus is provided. The compact energetic-breaching apparatus is configured to receive energetic materials for use in energetic breaching. The compact energetic-breaching apparatus may comprise a housing body with a receptacle to receive energetic materials. The compact energetic-breaching apparatus may further comprise a tamping material. The compact energetic-breaching apparatus may further comprise a metal liner which collapses upon detonation to form a cutting jet.

17 Claims, 25 Drawing Sheets

COMPACT ENERGETIC-BREACHING APPARATUS

CROSS-REFERENCE TO RELATED APPLICATIONS

This application is a continuation of—and claims priority to and the benefit of—U.S. application Ser. No. 16/906,815 titled "Compact Energetic-Breaching Apparatus" and filed Jun. 19, 2020, (the specification and claims of which are hereby incorporated herein by reference) which claimed priority both: (1) to U.S. Provisional Patent Application Ser. No. 62/981,296, titled "Compact Linear Energetic Breaching Apparatus to Increase Efficiency of Energetics and Reduce Fragmentation" and filed on Feb. 25, 2020 (the specification and claims of which are hereby incorporated herein by reference); and (2) to U.S. Provisional Patent Application Ser. No. 62/866,988, titled "Compact Linear Explosive Breaching Apparatus to Increase Efficiency of Explosives and Reduce Fragmentation" and filed Jun. 26, 2019 (the specification and claims of which are hereby incorporated herein by reference).

FIELD OF INVENTION

This disclosure relates generally to breaching apparatuses, i.e. devices for gaining entry by energetic force, and particularly to the field of using energetic material to produce minimal fragments when opening structures. Uses for this apparatus may include, but are not limited to, explosive ordnance disposal and breaching wood and metal doors, windows, gates, locks, and walls, all while using reduced amounts of explosives compared to traditional means of energetic breaching and while producing limited, mostly harmless fragmentation from the charge material.

BACKGROUND

Emergency-services personnel often must quickly and safely create openings in structures for various reasons. Fire-service personnel breach walls and doors when trying to control fires by venting the structure. Law enforcement, special-weapons-and-tactics (SWAT) teams, and special response teams engaged, e.g., in close-quarters battles or in hostage-rescue operations often must gain access to buildings and fenced compounds.

One option regularly used to create openings is explosive, or energetic, breaching. Given the variety of possible breaching scenarios, emergency-services personnel often must carry numerous different charges and other equipment to ensure their success. Additionally, the reduction of collateral damage is of vital necessity for the safety of innocent persons in the vicinity of the breach.

When breaching doors into areas where it is unknown who is on the other side of the wall, door, gate, or window, it is sometimes useful to minimize the amount of shrapnel produced when effecting the breach. It is also sometimes useful to ensure the emergency-services team staging near the breach point is not the casualty of flying debris upon charge detonation. Both of these potential problems can sometimes be resolved by using reduced amounts of energetics when constructing the charge, i.e. by reducing the net explosive weight ("N.E.W."). Reducing the N.E.W. may sometimes increase the chance for a failed breach. A failed breach may sometimes result in failing to control a fire, failing to save a hostage, losing evidence in an investigation, or alerting a suspect to the presence of law enforcement.

Various methods have been utilized in order to both lower the N.E.W. and ensure a positive breach. One method is based on the Munroe effect, which describes that, when a charge is shaped in a specific manner, the shockwaves are focused and increase the cutting effect of the charge. The effect can be enhanced—sometimes still with a low N.E.W.—by placing a metal liner in the charge that collapses upon detonation of the energetic material and forms a cutting jet that is driven into the target.

Another common method of reducing the N.E.W. is to use a tamper mass that can elongate and sustain the energetic force in a specific direction. One tamper mass in common use is water, encased, for example, in a bottle or bag. While tamper masses may reduce the necessary N.E.W. for a given charge and charge effect, they are sometimes bulky—making them difficult to carry, difficult to access, and difficult to deploy when necessary.

Given the varied nature of targets which an emergency-services, fire, or law-enforcement department may encounter, a vast knowledge of various energetic breaching techniques can be necessary to ensure that the right charge is available or able to be built for the mission at hand. Additionally, given the usual bulk of main charges, it is difficult to carry more than one or two options onto an objective. This may sometimes result in a 'use what you brought' attitude, which may create the possibility of having either a failed breach or an inordinately powerful charge used in a given situation.

Some embodiments disclosed herein may alleviate some of the above concerns. Some embodiments may be loaded with energetic materials quickly, simply, and in accord with mission requirements. Some embodiments may be dimensioned to fit into commercially available standard-sized pouches already in use by various emergency-services personnel. For example, in some embodiments, one to two might fit into a pistol magazine pouch, one to three or four might fit into a standard 5.56-mm—rifle magazine pouch, and one to four might fit into a standard 7.62-mm—rifle magazine pouch. Some embodiments may be dimensioned to fit suitably in various standard-size 'administrative' pouches that are commonly used by emergency-services personnel or built into standard clothing, vests, or accessories used by personnel that might use energetic materials. The ability to carry and store various charges in this convenient and organized manner may result in different charge N.E.W.'s being carried by different personnel so that, once the 'ground truth' is realized by the operational team, the team can use the proper charge.

Further, charges are often carried pre-built by a single or few emergency personnel in their vehicles, and the compact nature of some embodiments may allow multiple options to be available and to be clearly labeled by the factory. Additionally, multiple charges of the same N.E.W. can be carried when it is understood that the emergency-services personnel may encounter in succession several doors, windows, or walls of the same construction, for instance, in a school, hospital, or hotel where construction is generally uniform throughout.

Current carry procedures for multiple energetic options often have them disorganized in a pouch or minimally organized in elastic bands inside a bag, limiting the ease of access. By making convenient the method of carry, deployment of the energetic option may be further optimized at a time when seconds may be crucial to mission failure or success. In some embodiments, the charge may be quickly direct-primed once deployed, further reducing the N.E.W. and the response time. Some embodiments may further minimize fragmentation and shrapnel by reducing the N.E.W. necessary to effect a positive breach.

SUMMARY OF THE INVENTION

The present disclosure describes a compact energetic-breaching apparatus. In a first exemplary embodiment, a compact energetic-breaching apparatus is provided and comprises: a one-piece, substantially hollow housing body comprised of a frangible material and having a top face and a bottom face; and a channel formed in the housing body configured to receive energetic material; wherein the housing body is a right prism, and has a width of between approximately 10 mm and 50 mm, a depth of between approximately 10 mm and 150 mm, and a height of between approximately 75 mm and 300 mm; and wherein a tamping material substantially fills the housing body.

In a second exemplary embodiment, a compact energetic-breaching apparatus is provided and comprises: a substantially hollow housing body; and a channel formed in the housing body configured to receive energetic material, wherein the channel has a first cross section profile across a first channel length having a curved profile; wherein the housing body is a right prism, and has a width of between approximately 10 mm and 50 mm, a depth of between approximately 10 mm and 150 mm, and a height of between approximately 75 mm and 300 mm; and wherein a tamping material substantially fills the housing body.

In a third exemplary embodiment, a compact energetic-breaching apparatus is provided and comprises: a housing body comprised of a frangible material and having a top face and a bottom face; a channel formed in the housing body configured to receive energetic material; and wherein the channel extends from the top face to the bottom face and comprises a first cross section profile across a first length and a second cross section profile across a second length, wherein the first cross section profile and second cross section profile are different.

The above summary presents a simplified overview to provide a basic understanding of some aspects of the claimed subject matter. This summary is not an extensive overview. It is not intended to identify key or critical elements or to delineate the scope of the claimed subject matter. Its sole purpose is to present some concepts in a simplified form as a prelude to the more detailed description that is presented later.

BRIEF DESCRIPTION OF THE DRAWINGS

The following drawings are attached to—and form a portion of—this disclosure.

DEFINITIONS

Figure 1A:
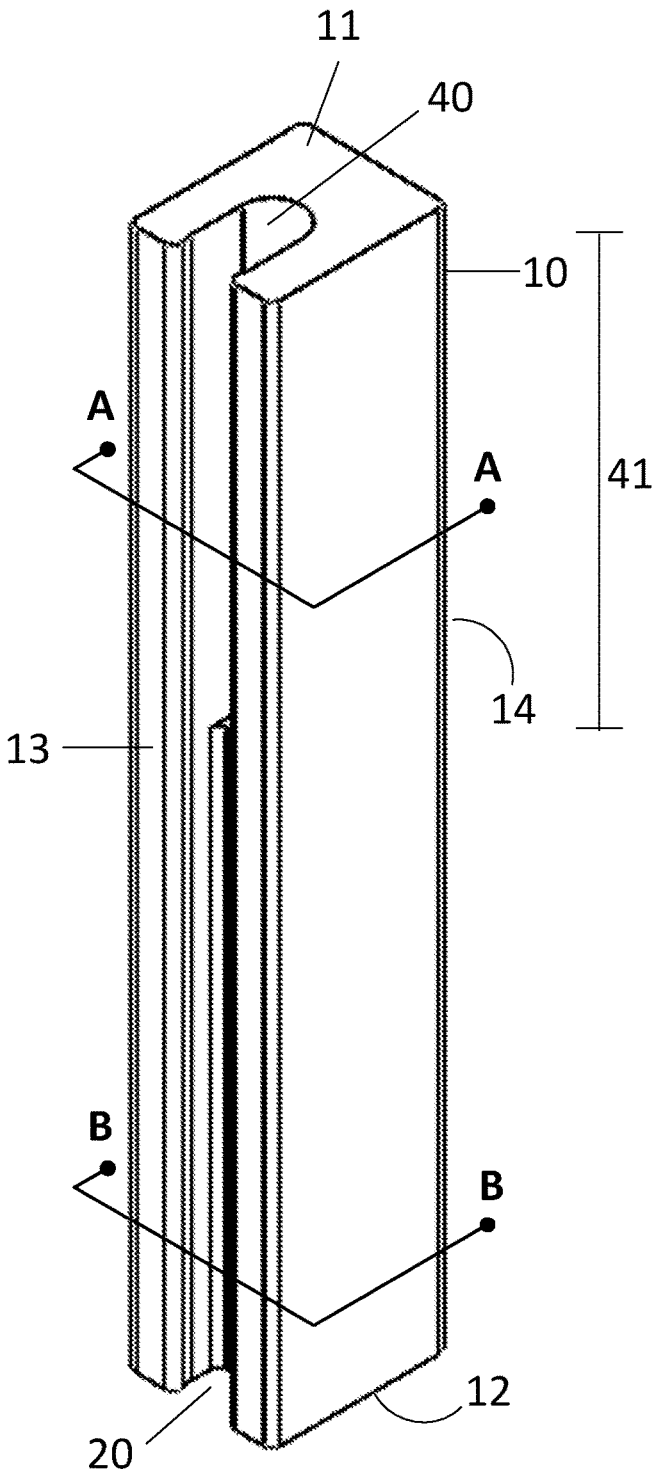
FIG. 1A is a perspective view of one embodiment of the compact energetic-breaching apparatus.
Figure 1B:
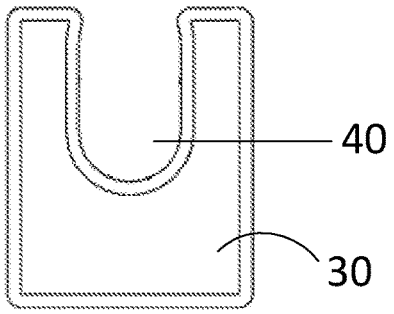
FIG. 1B is a cross section view of the embodiment of the compact energetic-breaching apparatus of FIG. 1A across line A-A.
Figure 1C:
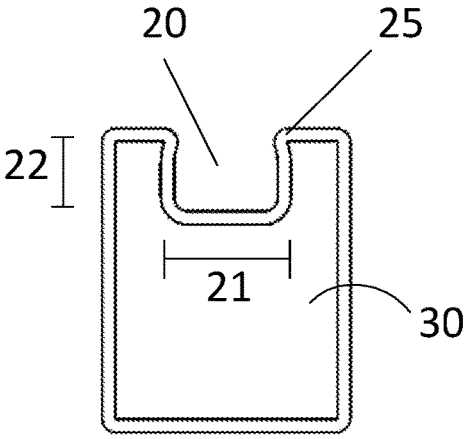
FIG. 1C is a cross section view of the embodiment of the compact energetic-breaching apparatus of FIG. 1A across line B-B.
Figure 1D:
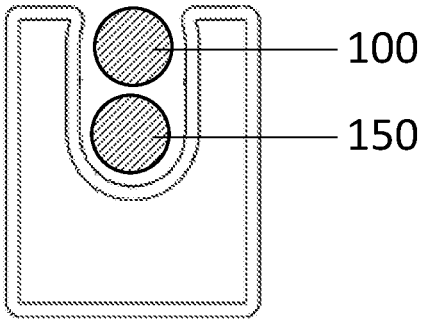
FIG. 1D is a cross section view of the embodiment of the compact energetic-breaching apparatus of FIG. 1A across line A-A showing a placement of energetic material and detonator.
Figure 1E:
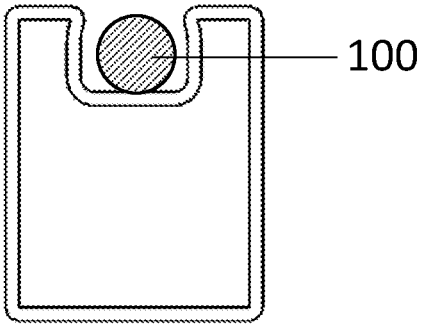
FIG. 1E is a cross section view of the embodiment of the compact energetic-breaching apparatus of FIG. 1A across line B-B showing a placement of energetic material.

Unless otherwise defined, all terms (including technical and scientific terms) in this disclosure have the same meaning as commonly understood by one of ordinary skill in the art of this disclosure. It will be further understood that terms, such as those defined in commonly used dictionaries, should be interpreted as having a meaning that is consistent with their meaning in the context of the specification and should not be interpreted in an idealized or overly formal sense unless expressly defined otherwise in this disclosure. For brevity or clarity, well known functions or constructions may not be described in detail.

The terms "about" and "approximately" shall generally mean an acceptable degree of error or variation for the quantity measured in light of the nature or precision of the measurements. Typical, exemplary degrees of error or variation are within 20 percent (%), preferably within 10%, more preferably within 5%, of a given value or range of values. Numerical quantities given in this description are approximate unless stated otherwise, meaning that the term "about" or "approximately" can be inferred when not expressly stated.

The terminology used throughout the disclosure is for the purpose of describing particular embodiments only and is not intended to be limiting. The singular forms "a," "an," and "the" are intended to include the plural forms as well, unless the context clearly indicates otherwise.

The terms "first," "second," and the like are used to describe various features or elements, but these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the disclosure. Likewise, terms like "top" and "bottom"; "front" and "back"; and "left" and "right" are used to distinguish certain features or elements from each other, but it is expressly contemplated that a top could be a bottom, and vice versa.

The term "consisting essentially of" means that, in addition to the recited elements, what is claimed may also contain other elements (steps, structures, ingredients, components, etc.) that do not adversely affect the operability of what is claimed for its intended purpose as stated in this disclosure. This term excludes such other elements that adversely affect the operability of what is claimed for its intended purpose as stated in this disclosure, even if such other elements might enhance the operability of what is claimed for some other purpose.

It is to be understood that any given elements of the disclosed embodiments of the invention may be embodied in a single structure, a single step, a single substance, or the like. Similarly, a given element of the disclosed embodiment may be embodied in multiple structures, steps, substances, or the like.

The following description illustrates and describes the processes, machines, manufactures, compositions of matter, and other teachings of the present disclosure. The disclosure shows and describes only certain embodiments of the processes, machines, manufactures, compositions of matter, and other teachings disclosed; but as mentioned above, it is to be understood that the teachings of the present disclosure are capable of use in various other combinations, modifications, and environments and are capable of changes or modifications within the scope of the teachings of this disclosure, commensurate with the skill and knowledge of a person having ordinary skill in the relevant art. The embodiments described are further intended to explain certain best modes known of practicing the processes, machines, manufactures, compositions of matter, and other teachings of the disclosure and to enable others skilled in the art to utilize the teachings of the disclosure in such, or other, embodiments and with the various modifications required by the particular applications or uses. Accordingly, the processes, machines, manufactures, compositions of matter, and other teachings of the present disclosure are not intended to limit the exact embodiments and examples disclosed herein. Any section headings herein are provided only for consistency with the suggestions of 37 C.F.R. § 1.77 or otherwise to provide organizational cues. These headings shall not limit or characterize the invention(s) set forth herein.

DETAILED DESCRIPTION

A compact energetic-breaching apparatus, methods of making a compact energetic-breaching apparatus, and methods of using a compact energetic-breaching apparatus have been developed and are described. As shown in the drawings, we generally discuss embodiments of the compact energetic-breaching apparatus for use with detonating cord, plastic explosives, moldable explosives, and sheet explosives. The specific details of the explosives, energetic materials, blasting caps, primers, boosters, etc., however, are not critical to the teachings of some embodiments in this disclosure. Variations could be advantageously combined with many different types of existing explosives. In other words, the teachings of this disclosure may be advantageous for use with energetic materials where it is desirable to perform energetic breaching.

1. Housing Body

Figure 2A:
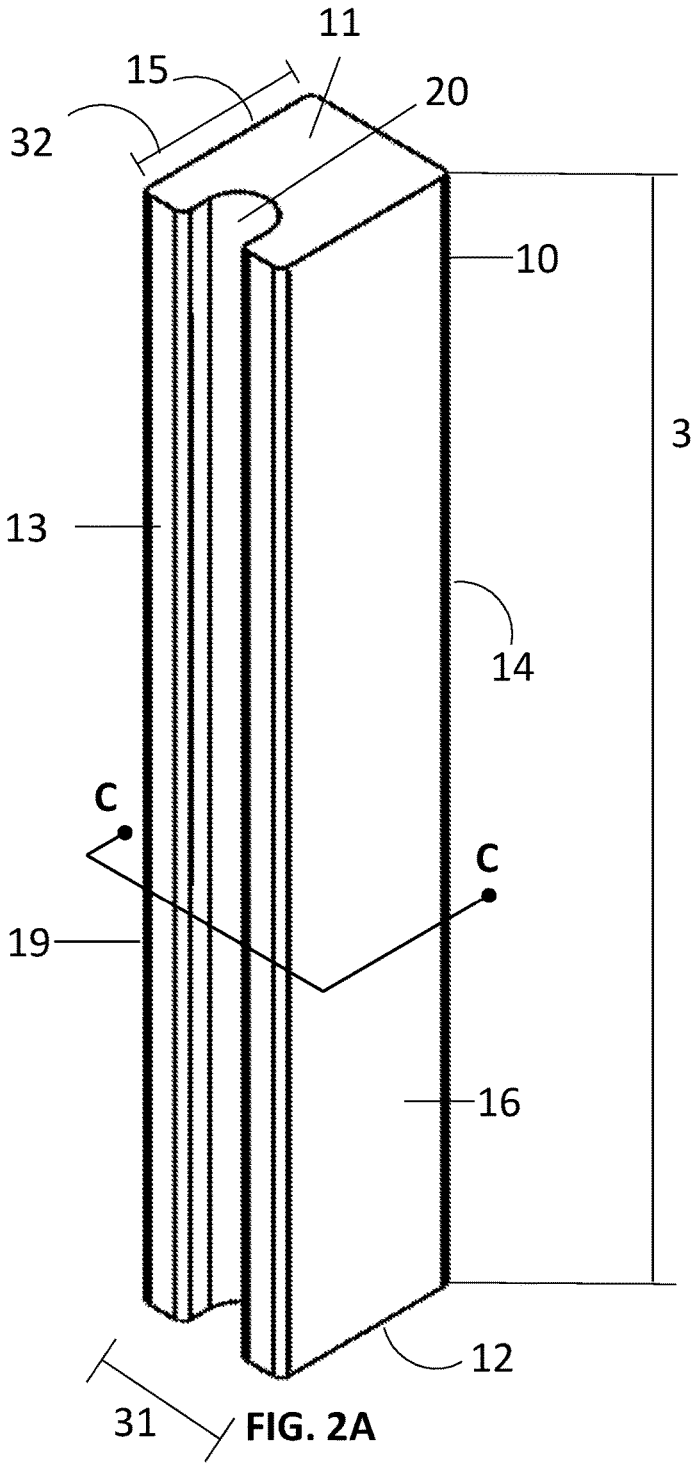
FIG. 2A is a perspective view of one embodiment of the compact energetic-breaching apparatus.
Figure 2C:
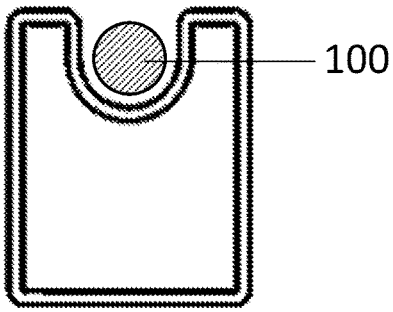
FIG. 2C is a cross section view of the embodiment of the compact energetic-breaching apparatus of FIG. 2A across line C-C showing a placement of energetic material.
Figure 2B:
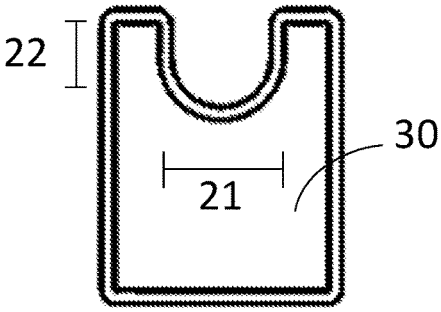
FIG. 2B is a cross section view of the embodiment of the compact energetic-breaching apparatus of FIG. 2A across line C-C.

Various exemplary embodiments of various aspects of a compact energetic-breaching apparatus are shown in FIGS. 1-20. As shown in FIGS. 1-20, some embodiments of a compact energetic-breaching apparatus may comprise a housing body 10. In some embodiments, as shown for example in FIG. 2, the housing body 10 may be shaped substantially as a right prism and may comprise a plurality of faces. For example, as shown in FIG. 2, the housing body may comprise a top face 11, a bottom face 12, a front face 13, a back face 14, a left face 15, and a right face 16. (In this disclosure, a "right prism" is a three-dimensional shape having at least one pair of faces which are substantially similar to each other and which are substantially parallel to each other. In some embodiments, for example as shown at least in FIG. 1, such a pair of faces may comprise the top face 11 and the bottom face 12. In some embodiments, for example as shown at least in FIG. 14, such a pair of faces may comprise the front face 13 and the back face 14. In some embodiments, for example as shown at least in FIG. 15, such a pair of faces may comprise the left face 15 and the right face 16. In some embodiments, as shown for example in FIG. 2, the housing body 10 may further comprise at least one edge 19, which may be between two or more faces. The labels "top face," "bottom face," "front face," "back face," "left face," and "right face" are only for convenience of reference. In some embodiments the housing body 10 may not have exactly six faces. In some embodiments, the housing body 10 may have more faces, fewer faces, or no faces at all. For example, in some embodiments, the housing body 10 may be shaped substantially as a right cylinder. In some embodiments, the housing body 10 may be shaped as other shapes. For example, in some embodiments, the housing body 10 may be shaped substantially as an oblique prism, as an oblique cylinder, as a sphere, or as any other shape.

In different embodiments, the housing body 10 may have different dimensions. For example, in some embodiments, the housing body 10 may be dimensioned to fit within a right cuboid of dimensions greater than approximately 10 mm wide by approximately 10 mm deep by approximately 75 mm tall and of dimensions less than approximately 50 mm wide by approximately 150 mm deep by approximately 300 mm tall. In some embodiments, these dimensions may allow the compact energetic-breaching apparatus to be more easily packed, stored, or organized, possibly with a consequently better-tailored choice of a particular embodiment for a particular job, which may sometimes allow for a lower N.E.W., a more compact embodiment, or a smaller form-factor.

In some embodiments, these dimensions may allow the compact energetic-breaching apparatus to fit into commercially available standard-sized pouches already in use by various emergency-services personnel. For example, in some embodiments, one to two might fit into a pistol magazine pouch, one to three or four might fit into a standard 5.56-mm—rifle magazine pouch (for example, a pouch having internal dimensions of approximately 68 mm by approximately 22 mm), or one to four might fit into a standard 7.62-mm—rifle magazine pouch (for example, a pouch having internal dimensions of approximately 85 mm by approximately 24 mm). Some embodiments may be dimensioned to fit suitably in various standard-size 'administrative' pouches that are commonly used by emergency-services personnel or built into standard clothing, vests, or accessories used by personnel that might use energetic materials. In some embodiments, the housing body 10 is shaped and dimensioned such that a set of five or six will fold together to fit into a pouch which is designed for a Mark 46 or Mark 48 machine-gun drum. In some embodiments, the housing body 10 is shaped and dimensioned such that a set of five or six will fold together into a standard military-issue—canteen pouch. In some embodiments, the housing body 10 is dimensioned to fit between the jamb and the handle or knob on common styles of doors, for example by having a dimension along at least one direction less than approximately 22 mm or less than approximately 18 mm.

In some embodiments, the housing body 10 is shaped and dimensioned to substantially match the exterior dimensions of commonly used rifle and pistol magazines. For example, in some embodiments, the housing body 10 may have dimensions that substantially match the exterior dimensions of a 5.56-mm magazine that complies with the NATO Standardization Agreement ("STANAG"), for example by having dimensions approximately 22 mm along a first direction and approximately 66 mm along a second direction. For another example, in some embodiments the housing body 10 may have dimensions that substantially match the exterior dimensions of a 7.62-mm magazine, for example by having dimensions approximately 25 mm along a first direction and approximately 80 mm along a second direction. In some embodiments, the housing body 10 may have other dimensions. Some examples of other dimensions of the housing body 10 are described with respect to some embodiments described below.

In different embodiments, the housing body 10 may be made of different materials. For example, in some embodiments, the housing body 10 may be formed of plastic (including, e.g., injection-molded plastic and other commercially molded thermoplastics), nylon (including, e.g., Nylon 11, Polyamide 11 (PA 11), Nylon 12, Polyamide 12 (PA 12), and other custom blends), metal, wood, or some combination of the foregoing. In some embodiments, the housing body 10 may be formed of acrylonitrile butadiene styrene (ABS), glycol-modified polyethylene terephthalate (PETG), other thermoplastic polymer, or other polymeric material. In some embodiments, the housing body 10 may be formed of circularly layered polymeric material. In some embodiments, the housing body 10 may be formed of a material that will mostly disintegrate upon detonation without generating significant dangerous fragments. In some embodiments, the use of such a material may allow for a reduction in damaging effects on the environment, the emergency-services personnel, or those in the area of the breach. For example, in some embodiments, the housing body 10 may be formed of a material made by layering ABS, PETG, other thermoplastic polymer, or other polymeric materials in a circular pattern during the production process. In some embodiments, the housing body may be formed of any frangible material. In this disclosure, a "frangible material" may include any material that, on detonation or explosion of the energetic material, generally breaks down into pieces or particles no longer than 10 mm. In this disclosure, a "frangible material" may also include material that, on detonation or explosion of the energetic material, generally breaks down into pieces or particles no heavier than 1 gram. For example, in some embodiments, a frangible material is formed of circularly layered polymeric material. In some embodiments, the use of such a material may allow the housing body 10, upon detonation, to be reduced to light-weight, pre-shredded pieces having limited hazard or limited environmental effects.

In some embodiments, as shown for example in FIGS. 1-17, 19, and 20 the housing body 10 may be substantially of one piece (i.e., substantially of monolithic construction), as opposed to assembled of multiple pieces. In some embodiments, this one-piece construction may allow the compact energetic-breaching apparatus to be carried more easily or to be deployed more quickly. In some embodiments substantially of monolithic construction, some pieces may optionally be snap-fit together, for example a snap-fit cover. In some embodiments, the housing body 10 may have varying cross sections, for example, a first cross section across a first length and a second cross section across a second length. The housing body 10 can also have a third cross section across a third length and a fourth cross section across a fourth length. For example, the embodiment in FIG. 12 has the cross section shown in FIG. 12B across the line Q-Q, the cross section shown in FIG. 12C across the line R-R, and the cross section shown in FIG. 12D across the line S-S.

In some embodiments, as shown for example in FIG. 2, the housing body 10 may be substantially hollow. For example, and as shown in FIG. 2, in some embodiments the housing body 10 may be formed of material with a wall thickness less than approximately 5 mm, preferably less than approximately 3 mm, more preferably less than approximately 2 mm. In some embodiments, the housing body 10 may be not hollow.

2. Tamping Material

In some embodiments, a compact energetic-breaching apparatus may further comprise a tamping material 30. In some embodiments, as shown for example in FIG. 2, a housing body 10 that is substantially hollow may be substantially filled with the tamping material 30. In some embodiments, the tamping material 30 may be, for examples, water, water-based gel, hydrogel, polymer-based gel, or any other suitable tamping material. In such embodiments, the tamping material 30 may elongate and sustain the force in a direction or provide a pushing effect on the target. In some embodiments, a housing body 10 that is substantially hollow may be delivered already filled or substantially filled with the tamping material 30. In some embodiments, a housing body 10 that is substantially hollow may be delivered with no tamping material 30. In some embodiments, the housing body 10 may have an opening, either sealable or resealable, to fill the housing body 10 with tamping material 30, if desired. In some embodiments the sealable or resealable opening may be water-tight.

Figure 14A:
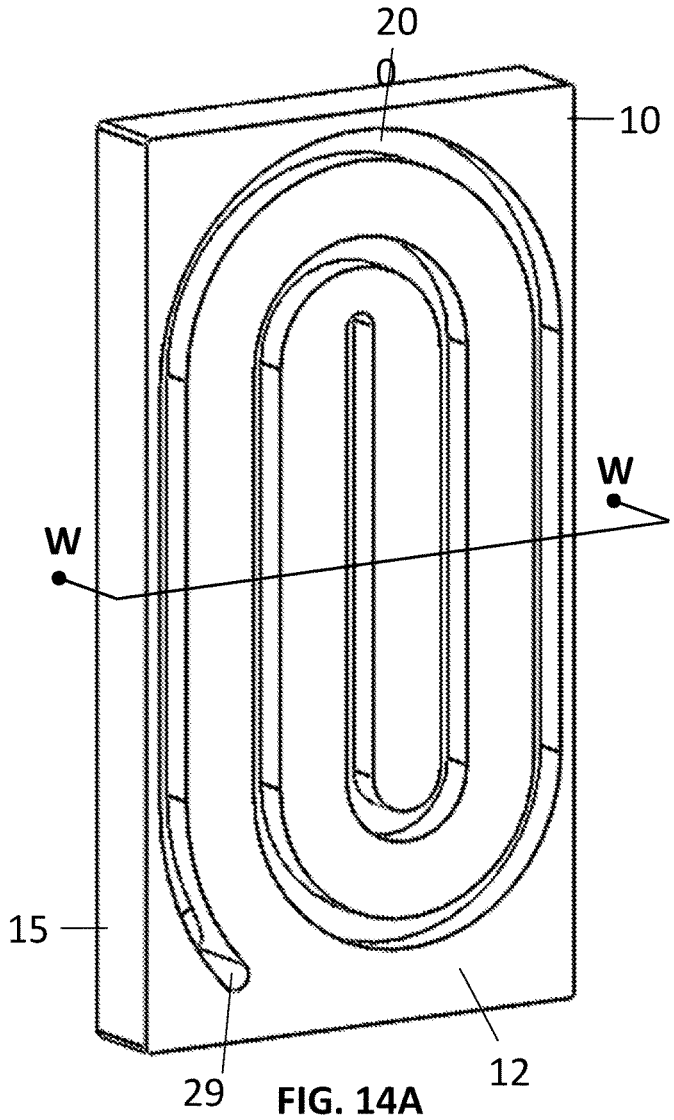
FIG. 14A is a bottom perspective view of one embodiment of the compact energetic-breaching apparatus.
Figure 14C:
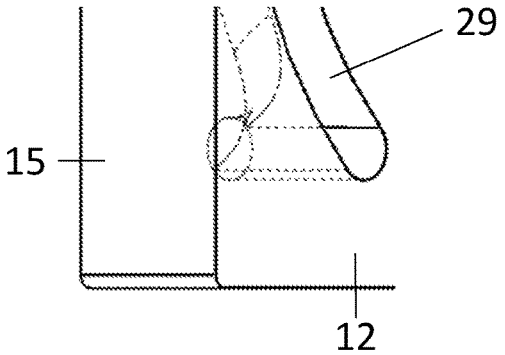
FIG. 14C is a bottom perspective detail view of the channel of the embodiment of the compact energetic-breaching apparatus of FIG. 14A.
Figure 14D:
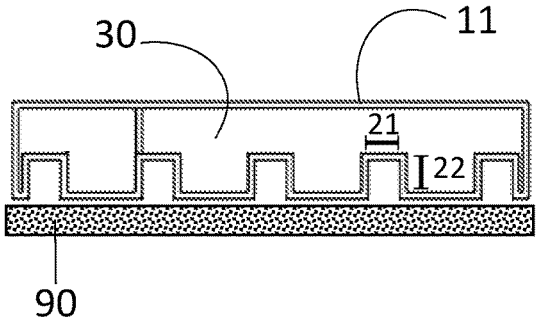
FIG. 14D is a cross section view of the embodiment of the compact energetic-breaching apparatus of FIG. 14A across line W-W showing a push plate.
Figure 14B:
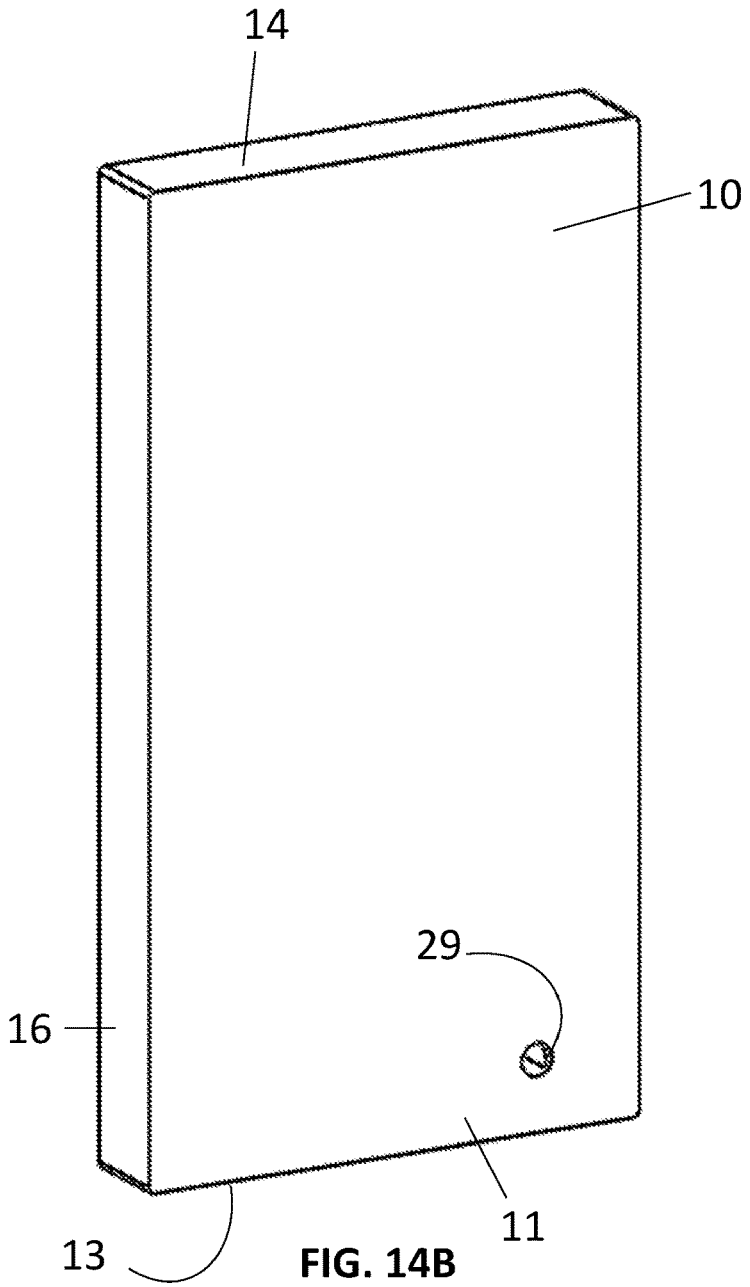
FIG. 14B is a top perspective view of the embodiment of the compact energetic-breaching apparatus of FIG. 14A.
Figure 14E:
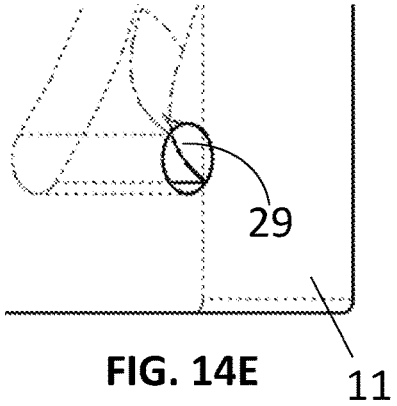
FIG. 14E is a top perspective detail view of the channel of the embodiment of the compact energetic-breaching apparatus of FIG. 14A.

In some embodiments, a compact energetic-breaching apparatus may further comprise a push plate 90, an example of which is shown in FIG. 14D. In some embodiments, the push plate 90 may be made of rubber, carbon material, magnetic material, or any other suitable material. In some embodiments, the push plate 90 may be affixed to a face, for example the bottom face 12. In some embodiments, as shown for example in FIG. 14, the push plate 90 may have the same width and depth as the housing body 10. In some embodiments, the push plate 90 may help to distribute to the target the force from the detonation. In some embodiments, no push plate 90 is used.

3. Channel

In some embodiments—as shown for example in FIGS. 1-20, the housing body 10 of a compact energetic-breaching apparatus may further comprise a channel 20 for receiving energetic material. In some embodiments, the channel 20 may extend from near a first face to near a second face. For example, as shown in FIG. 9, the channel 20 may extend from near the top face 11 to near the bottom face 12. In some such embodiments, the channel 20 may extend from the first face to the second face. For example, as shown in FIG. 2, the channel 20 may extend from the top face 11 to the bottom face 12. In some embodiments, the channel 20 may be positioned on a third face; for example, in the embodiment of FIG. 2, the channel 20 is positioned on the front face 13. In some embodiments, the channel 20 may be positioned on an edge 19; for example, in the embodiment of FIG. 7A, the channel 20 is positioned on an edge 19 between the front face 13 and the left face 15. In some embodiments, the channel 20 is not positioned on any face; for example, in the embodiment of FIG. 11, the channel 20 is not positioned on any face but is instead a through hole extending from the top face 11 to the bottom face 12.

3.1 Channel—Curved Profile

In different embodiments, the channel 20 may be differently shaped. In some embodiments—for examples, as shown in FIGS. 2, 3, 6, 7, 8, 11, 14, 15, 16, and 17—the channel 20 may have a curved profile. As used in this disclosure, "curved profile" may include both profiles which are entirely curved and profiles any section of which are curved despite also having straight sections. For example, in the embodiment of FIG. 2, the channel 20 has a curved profile because one section of the profile is semi-circular, though two sections of the profile are straight. For another example, in the embodiment of FIG. 11, the channel 20 has a curved profile because the profile includes curved sections. For clarity purposes only—and not to limit embodiments disclosed by FIG. 4—in the embodiment of FIG. 4, the channel 20 does not have a curved profile, because the profile only has straight sections.

Figure 3A:
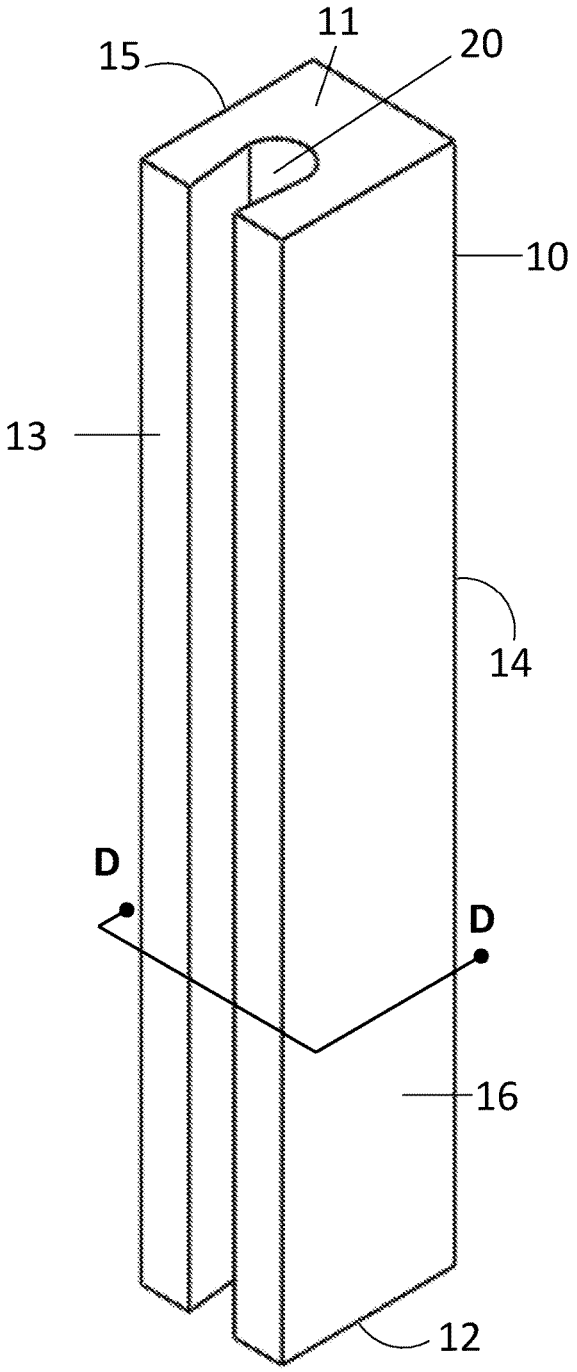
FIG. 3A is a perspective view of one embodiment of the compact energetic-breaching apparatus.
Figure 3C:
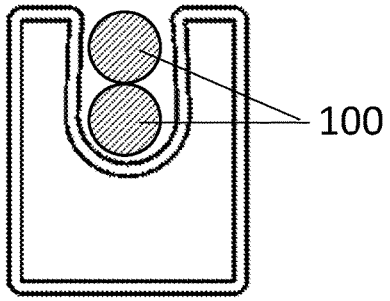
FIG. 3C is a cross section view of the embodiment of the compact energetic-breaching apparatus of FIG. 3A across line D-D showing a placement of energetic material.
Figure 3B:
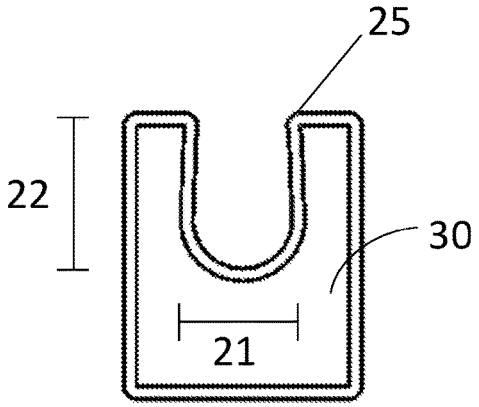
FIG. 3B is a cross section view of the embodiment of the compact energetic-breaching apparatus of FIG. 3A across line D-D.
Figure 4A:
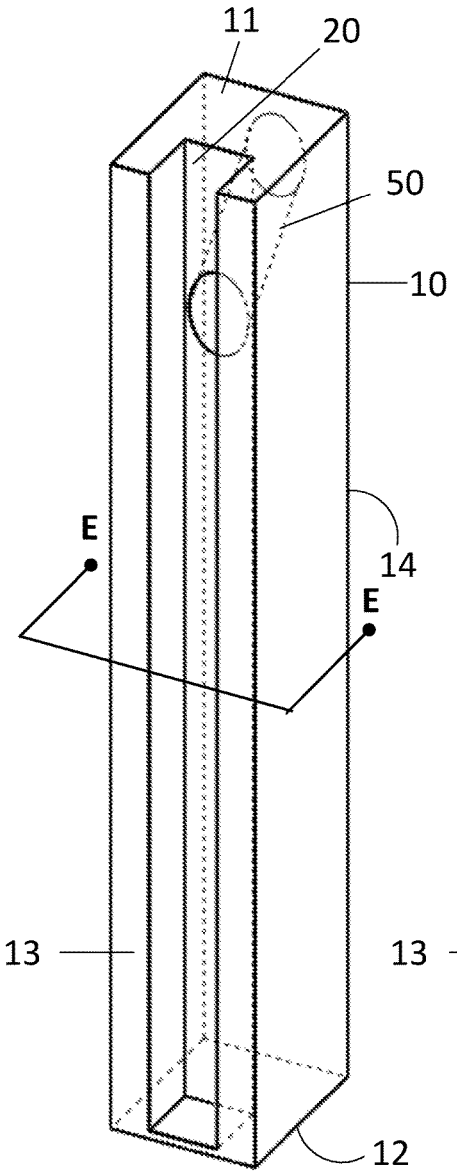
FIG. 4A is a front perspective view of one embodiment of the compact energetic-breaching apparatus.
Figure 4B:
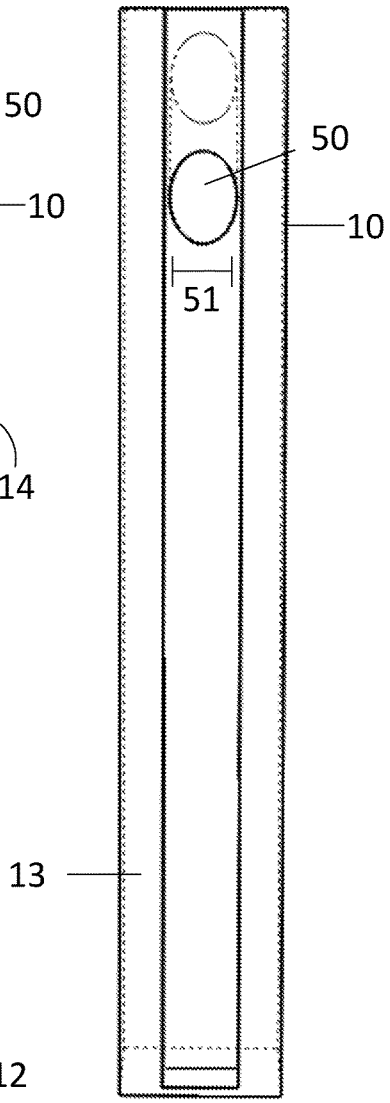
FIG. 4B is a back view of the embodiment of the compact energetic-breaching apparatus of FIG. 4A.
Figure 4C:
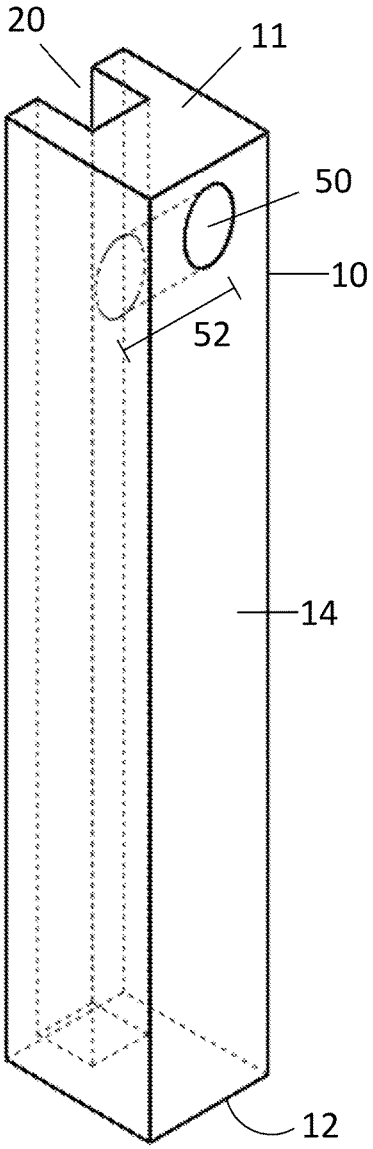
FIG. 4C is a back perspective view of the embodiment of the compact energetic-breaching apparatus of FIG. 4A.
Figure 4D:
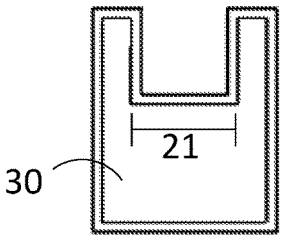
FIG. 4D is a cross section view of the embodiment of the compact energetic-breaching apparatus of 4A across line E-E.
Figure 11A:
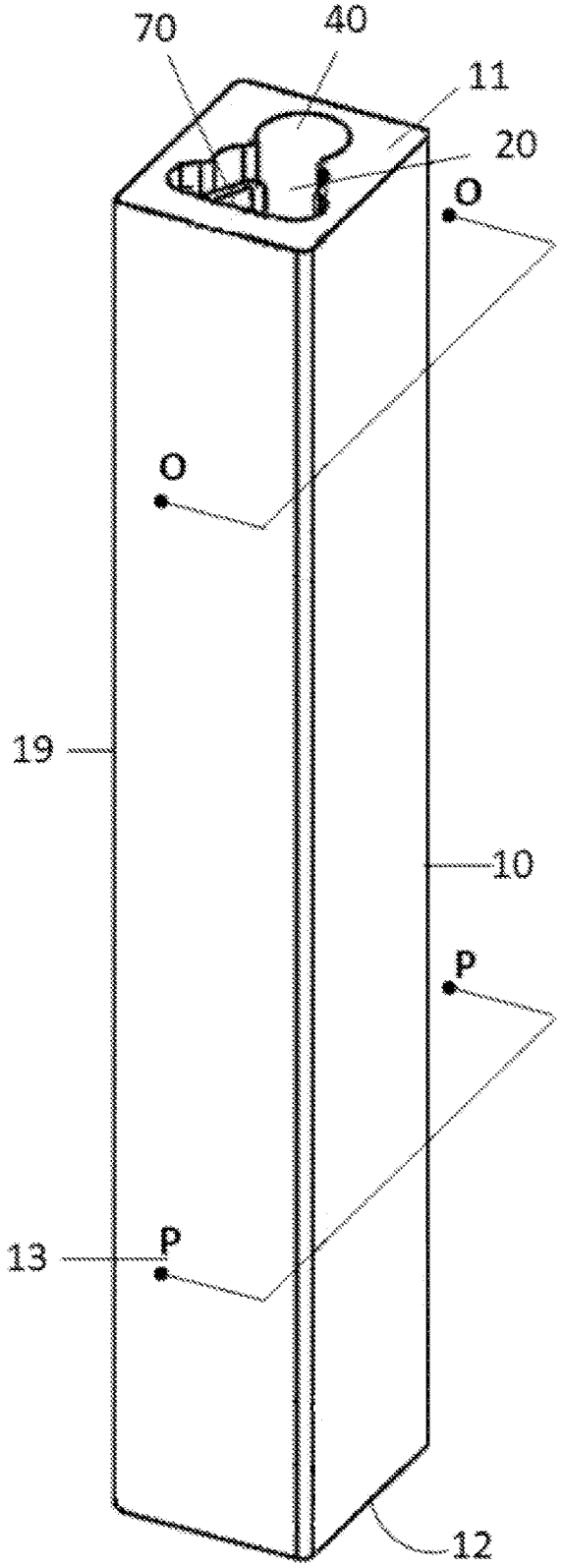
FIG. 11A is a front perspective view of one embodiment of the compact energetic-breaching apparatus.
Figure 11B:
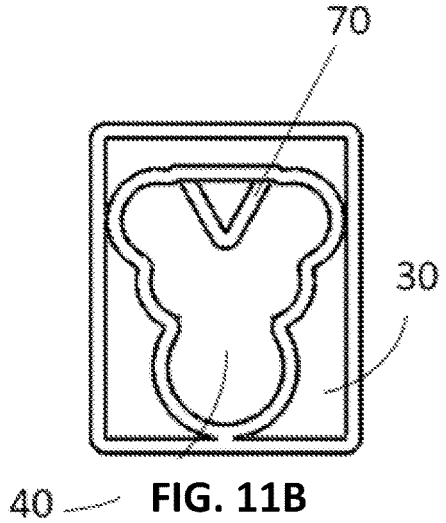
FIG. 11B is a cross section view of the embodiment of the compact energetic-breaching apparatus of FIG. 11A across line O-O.
Figure 11C:
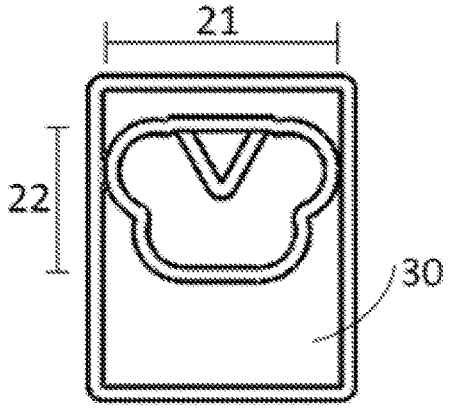
FIG. 11C is a cross section view of the embodiment of the compact energetic-breaching apparatus of FIG. 11A across line P-P.
Figure 11D:
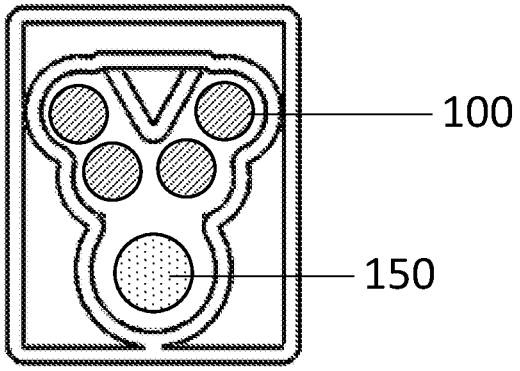
FIG. 11D is a cross section view of the embodiment of the compact energetic-breaching apparatus of FIG. 11A across line O-O showing a placement of energetic material and detonator.
Figure 11E:
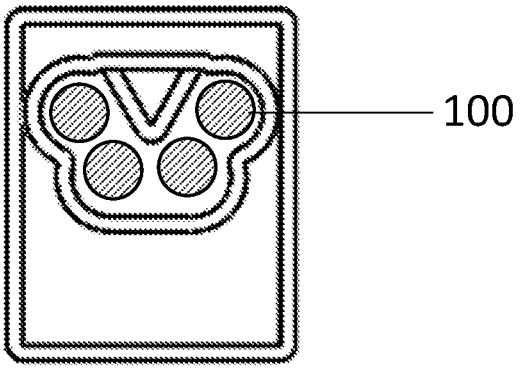
FIG. 11E is a cross section view of the embodiment of the compact energetic-breaching apparatus of FIG. 11A across line P-P showing a placement of energetic material.
Figure 12A:
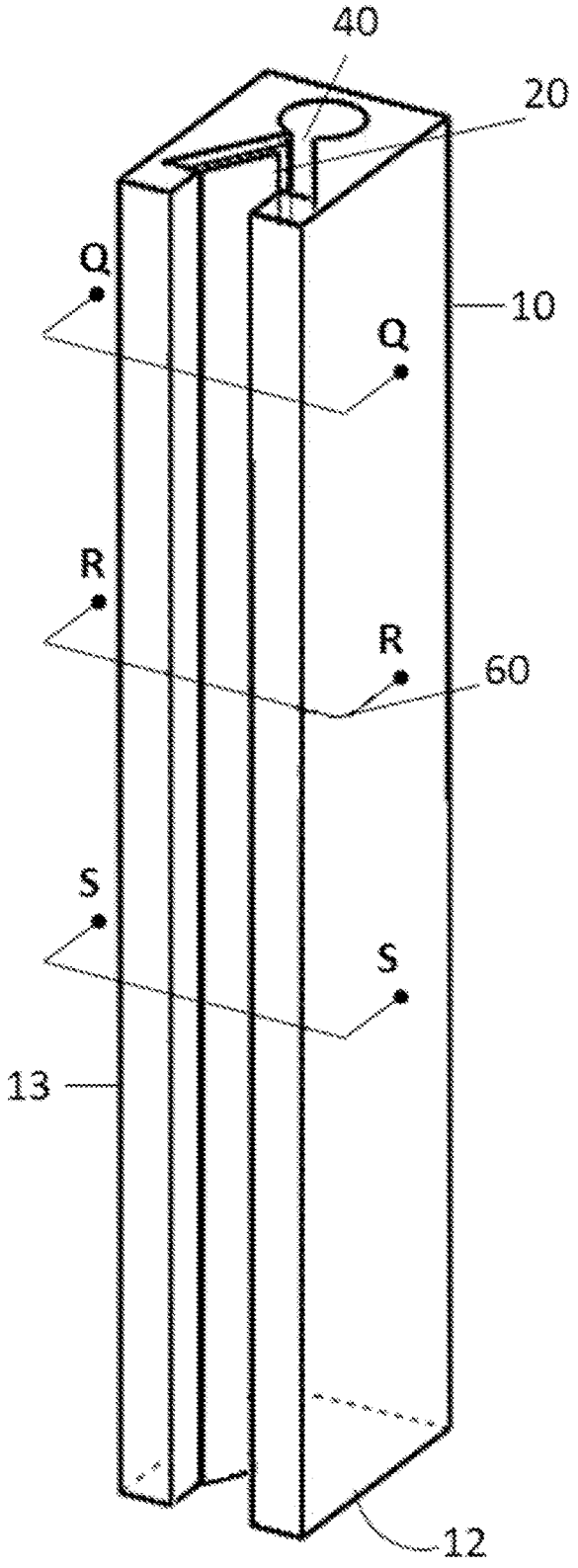
FIG. 12A is a front perspective view of one embodiment of the compact energetic-breaching apparatus.
Figure 12B:
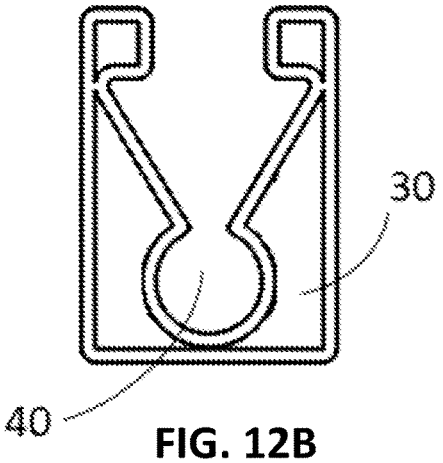
FIG. 12B is a cross section view of the embodiment of the compact energetic-breaching apparatus of FIG. 12A across line Q-Q.
Figure 12C:
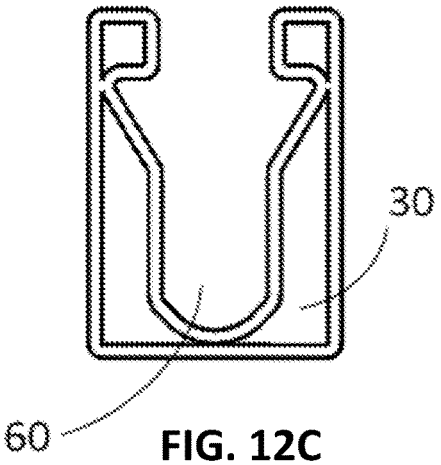
FIG. 12C is a cross section view of the embodiment of the compact energetic-breaching apparatus of FIG. 12A across line R-R.
Figure 12D:
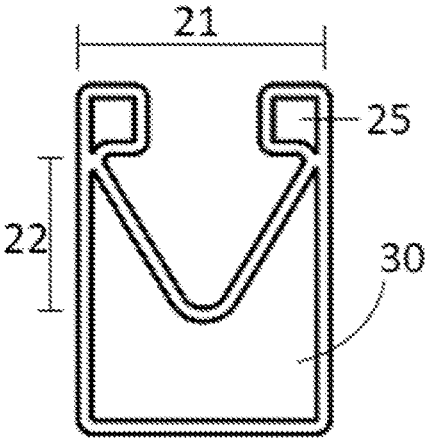
FIG. 12D is a cross section view of the embodiment of the compact energetic-breaching apparatus of FIG. 12A across line S-S.
Figure 12E:
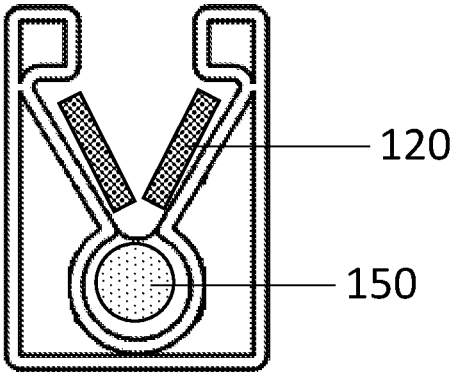
FIG. 12E is a cross section view of the embodiment of the compact energetic-breaching apparatus of FIG. 12A across line Q-Q showing a placement of energetic material and detonator.
Figure 12F:
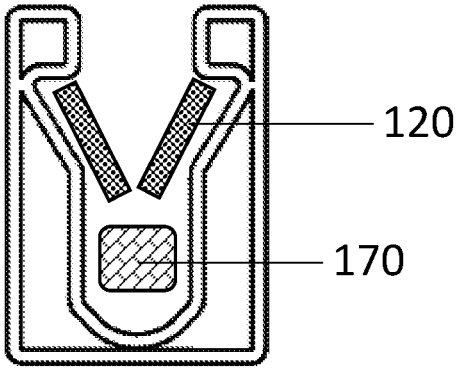
FIG. 12F is a cross section view of the embodiment of the compact energetic-breaching apparatus of FIG. 12A across line R-R showing a placement of energetic material and booster.
Figure 12G:
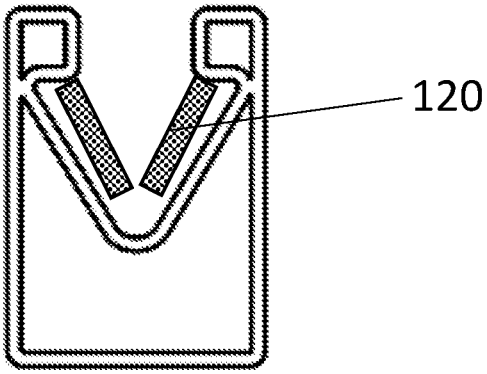
FIG. 12G is a cross section view of the embodiment of the compact energetic-breaching apparatus of FIG. 12A across line S-S showing a placement of energetic material.
Figure 13A:
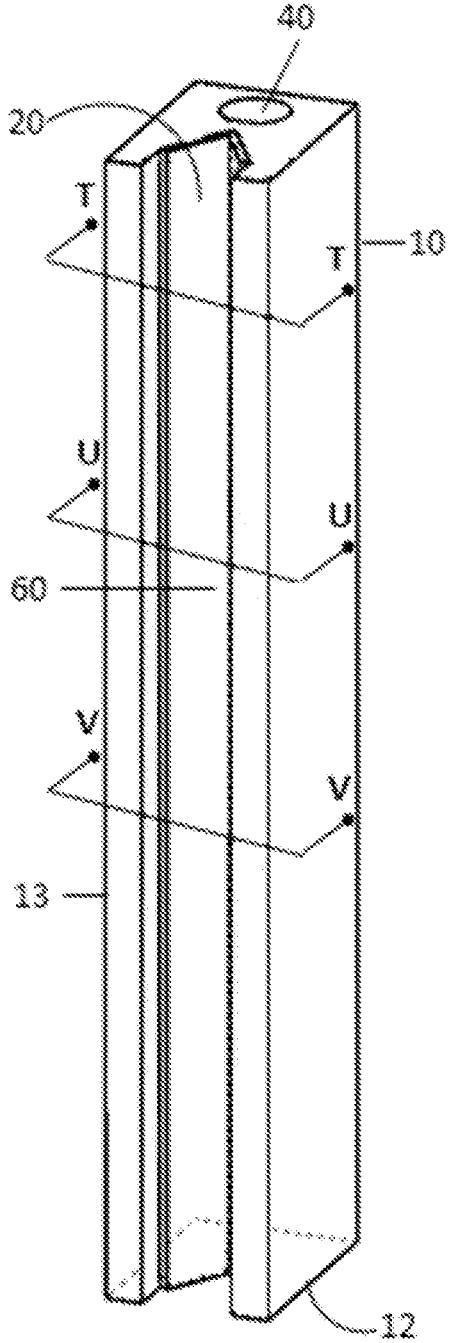
FIG. 13A is a front perspective view of one embodiment of the compact energetic-breaching apparatus.
Figure 13B:
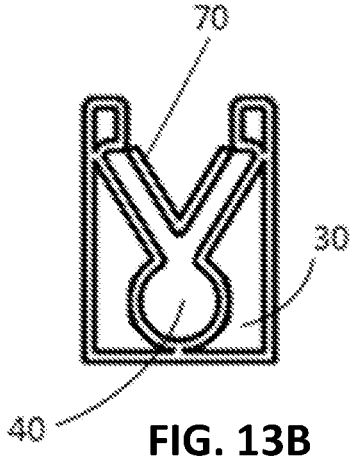
FIG. 13B is a cross section view of the embodiment of the compact energetic-breaching apparatus of FIG. 13A across line T-T.
Figure 13C:
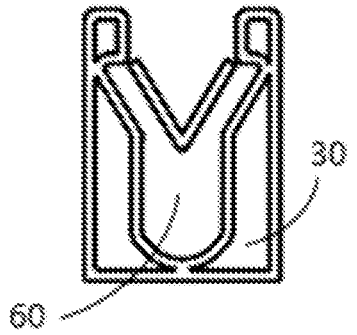
FIG. 13C is a cross section view of the embodiment of the compact energetic-breaching apparatus of FIG. 13A across line U-U.
Figure 13D:
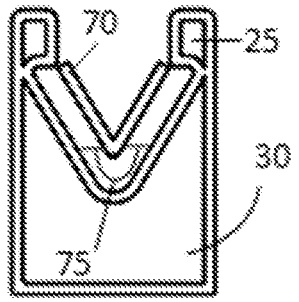
FIG. 13D is a cross section view of the embodiment of the compact energetic-breaching apparatus of FIG. 13A across line V-V.
Figure 16A:
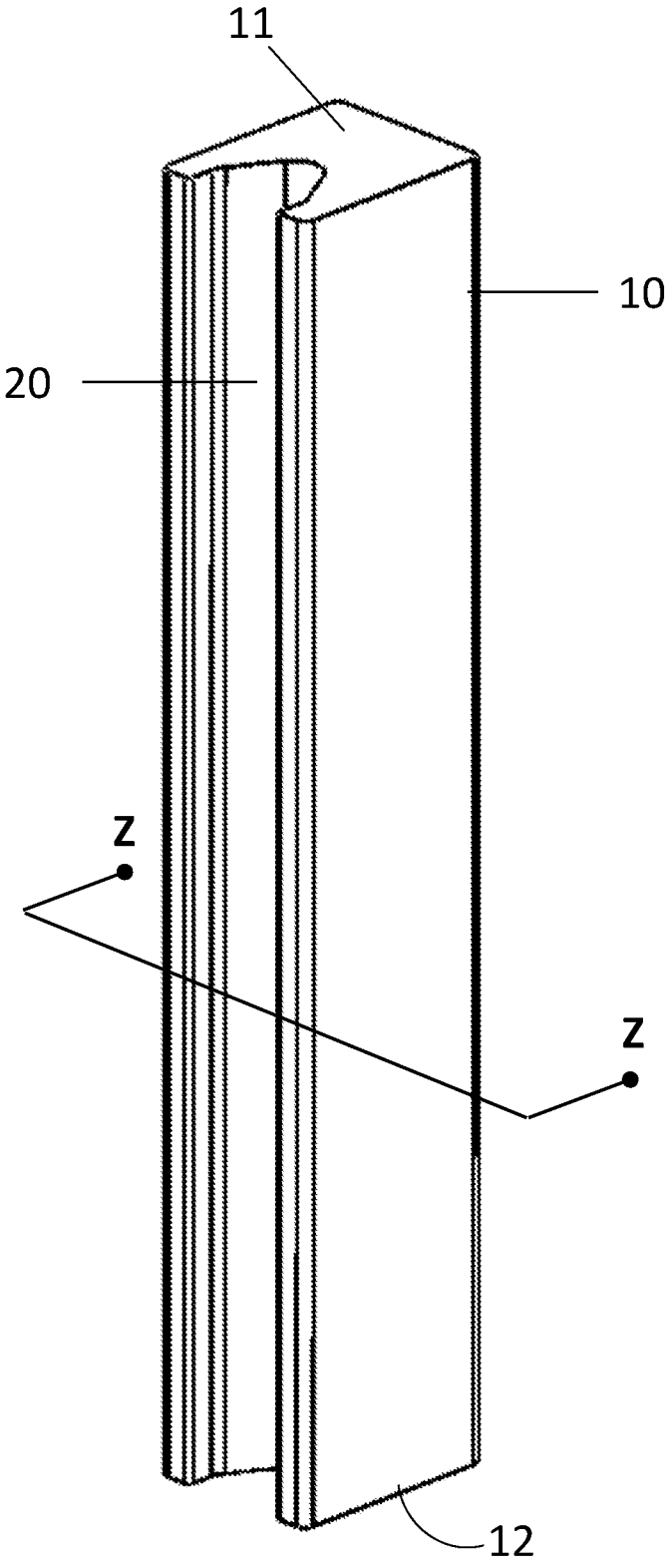
FIG. 16A is a front perspective view of one embodiment of the compact energetic-breaching apparatus.
Figure 16B:
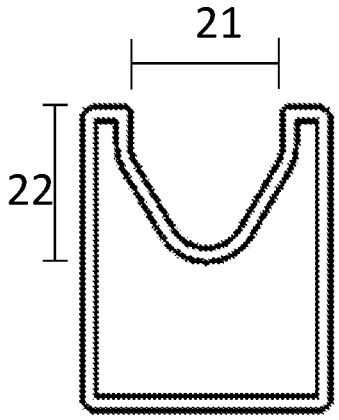
FIG. 16B is a cross section view of the embodiment of the compact energetic-breaching apparatus of FIG. 16A across line Z-Z.
Figure 17A:
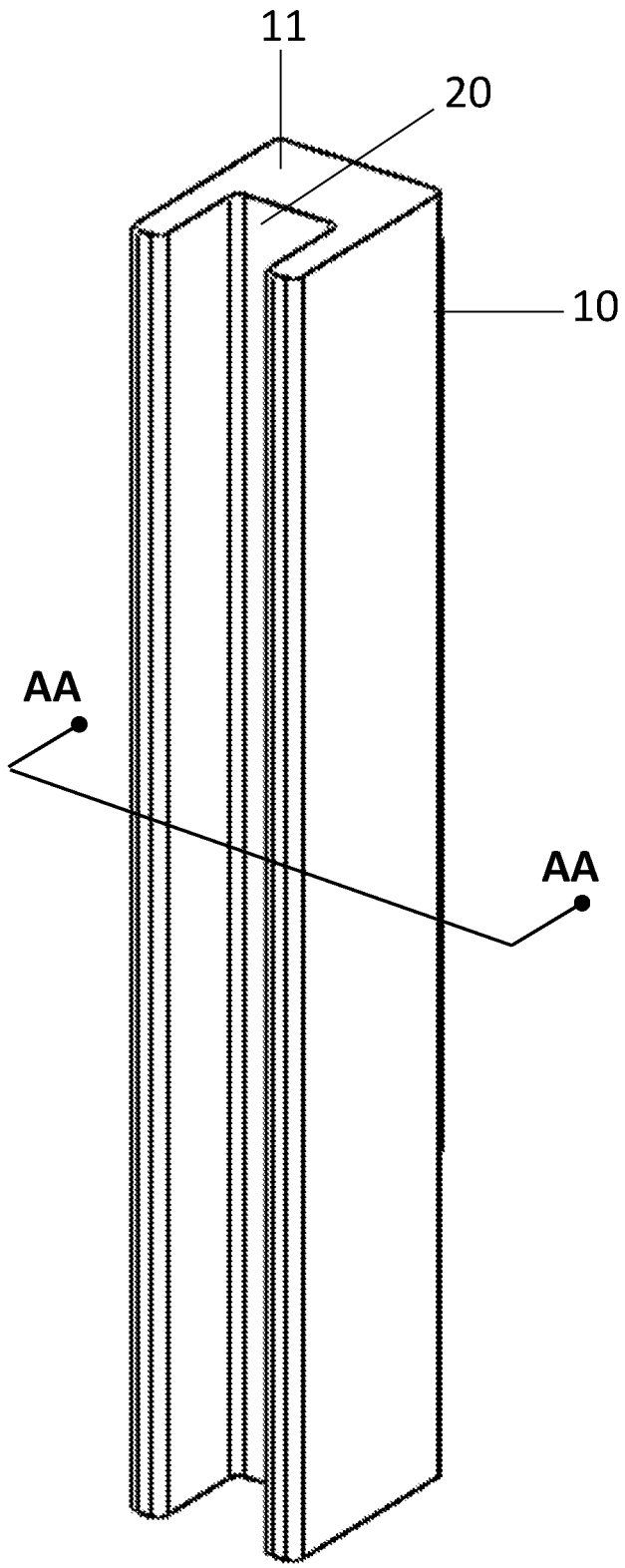
FIG. 17A is a front perspective view of one embodiment of the compact energetic-breaching apparatus.
Figure 17B:
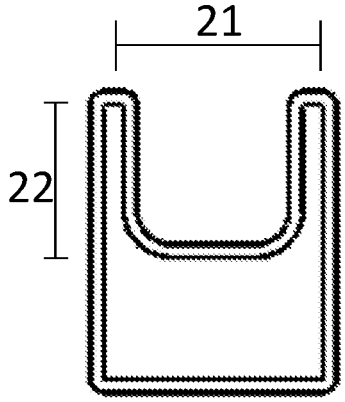
FIG. 17B is a cross section view of the embodiment of the compact energetic-breaching apparatus of FIG. 17A across line AA-AA.

In some embodiments, preferably those in which the channel 20 has a curved profile, the channel 20 may be shaped to receive at least one detonating cord. For example, as shown in FIG. 2, in some embodiments the channel 20 may have a curved profile and may be shaped to receive a detonating cord 100. For another example, as shown in FIG. 3, in some embodiments the channel 20 may have a curved profile and may be shaped to receive two detonating cords 100. For another example, as shown in FIG. 16, in some embodiments the channel 20 may have a curved profile and may be shaped to receive three detonating cords. For another example, as shown in FIG. 17, the channel 20 may have a curved profile and may be shaped to receive four detonating cords. For another example, as shown in FIG. 11D and FIG. 11E, in some embodiments the channel 20 may have a curved profile and may be shaped to receive one, two, three, four, or more detonating cords 100.

Further, in embodiments in which the channel 20 has a curved profile, the channel 20 may be dimensioned to receive at least one detonating cord, preferably in a snug fit. For example, as shown in FIG. 2, in some embodiments the channel 20 may have a curved profile and may be dimensioned to receive a detonating cord 100, for example one standard-size detonating cord. For example, the channel 20 of an embodiment—for example, one shown in FIG. 2—may have: (1) a channel width 21 between approximately 5 mm and approximately 9 mm, preferably between approximately 6 mm and approximately 8 mm, and more preferably approximately 7 mm; and (2) a channel depth 22 between approximately 5 mm and approximately 9 mm, preferably between approximately 6 mm and approximately 8 mm, and more preferably approximately 7 mm. In some such embodiments, these dimensions may allow the channel 20 to receive a standard-size detonating cord. In some embodiments, the ratio of the channel width 21 to the channel depth 22 may be approximately 1:1.

It should also be noted that the figures that show potential placement of detonating cords 100, sheet explosive 120, detonator 150, and/or booster 170 (e.g., FIGS. 1D, 1E, 2C, 3C, 5E-5G, etc.) are not to scale and utilized more generally to show what components may be used in actual practice in the field to better describe and understand particular embodiments.

In some such embodiments, as shown for example in FIG. 2, the housing body 10 may have a housing body width 31, housing body depth 32, and a housing body height 33. The dimensions of the housing body 10 may vary depending on the application. For example, with reference to FIG. 2, dimension ranges of the housing body 10 of some embodiments may include those ranges and specific dimensions shown in TABLE 1 below:

TABLE 1

| Approx. Width (mm) Range | Approx. Depth (mm) Range | Approx. Height (mm) Range |
|---|---|---|
| 10-35 | 10-35 | 75-300 |
| 12-30 | 12-25 | 95-200 |
| 15-27 | 15-22 | 115-160 |
| 22 | 18 | 125 |
| 25 | 18 | 125 |
| 22 | 18 | 150 |
| 25 | 18 | 150 |

In some embodiments, these dimensions may allow the compact energetic-breaching apparatus to be more easily packed, stored, or organized, possibly with a consequently better-tailored choice of a particular embodiment for a particular job, which may sometimes allow for a lower N.E.W., a more compact embodiment, or a smaller form-factor. In some embodiments, these dimensions may allow the compact energetic-breaching apparatus to fit into commercially available standard-sized pouches already in use by various emergency-services personnel. For example, in some embodiments, one to two might fit into a pistol magazine pouch, one to three or four might fit into a standard 5.56-mm—rifle magazine pouch, or one to four might fit into a standard 7.62-mm—rifle magazine pouch. Some embodiments may be dimensioned to fit suitably in various standard-size 'administrative' pouches that are commonly used by emergency-services personnel or built into standard clothing, vests, or accessories used by personnel that might use energetic materials.

For another example, as shown in FIG. 3, in some embodiments the channel 20 may have a curved profile and may be dimensioned to receive at least two detonating cords 100, for example at least two standard-size detonating cords. For example, the channel 20 of an embodiment—for example, one shown in FIG. 3—may have: (1) a channel width 21 between approximately 5 mm and approximately 9 mm, preferably between approximately 6 mm and approximately 8 mm, and more preferably approximately 7.5 mm; and (2) a channel depth 22 between approximately 10 mm and approximately 14 mm, preferably between approximately 11 mm and approximately 13 mm, more preferably approximately 12.5 mm. In some embodiments, the channel width 21 is narrower at the face than at widest point of the channel 20; for example, as shown in FIG. 3, the channel width 21 may narrow to approximately 6.25 mm at the face from approximately 7.5 mm at the widest point. In some embodiments, as shown in FIG. 3, this allows the channel 20 to retain either two detonating cords or a detonating cord and detonator. In some such embodiments, these dimensions may allow the channel 20 to receive two standard-size detonating cords. In some embodiments, the ratio of the channel width 21 to the channel depth 22 may be approximately 3:5 or approximately 1:2.

The dimensions of the housing body 10 may vary depending on the application. For example, with reference to FIG. 3, dimension ranges can be similar or identical to the ranges and dimensions discussed above with regard to FIG. 2 and TABLE 1. Such dimensions may allow the same form-factor and packing benefits discussed above.

For another example, as shown in FIG. 16, in some embodiments the channel 20 may have a curved profile and may be dimensioned to receive at least three detonating cords, for example three standard-size detonating cords. For example, the channel 20 of an embodiment—for example, one shown in FIG. 16—may have a profile shaped approximately as an equilateral triangle having side lengths between approximately 9 mm and approximately 14 mm, preferably between approximately 10 mm and approximately 13 mm, and more preferably approximately 11 mm. In some such embodiments, the channel may have an overall channel depth 22 between approximately 7.7 mm and approximately 12.2 mm, preferably approximately 9.5 mm; a channel width 21, as measured at the apex, between approximately 5 mm and approximately 9 mm, preferably between approximately 6 mm and approximately 8 mm, more preferably approximately 7.5 mm; and a channel width 21, as measured at the face, approximately twice the channel width 21 as measured at the apex. In some such embodiments, these dimensions may allow the channel 20 to receive three standard-size detonating cords, for example with one positioned in the apex of the approximate triangle and two additional cords positioned on top of the single detonating cord. The width of the channel near the apex can have a width as described with respect to FIG. 2 and/or FIG. 3.

The dimensions of the housing body 10 may vary depending on the application. For example, with reference to FIG. 16, dimension ranges of the housing body 10 of some embodiments may include those ranges and specific dimensions shown in TABLE 2 below:

TABLE 2

| Approx. Width (mm) Range | Approx. Depth (mm) Range | Approx. Height (mm) Range |
|---|---|---|
| 15-35 | 12-35 | 75-300 |
| 16-30 | 13-25 | 95-200 |
| 17-27 | 15-22 | 115-160 |
| 22 | 18 | 125 |

TABLE 2-continued

| Approx. Width (mm) Range | Approx. Depth (mm) Range | Approx. Height (mm) Range |
|---|---|---|
| 25 | 18 | 125 |
| 22 | 18 | 150 |
| 25 | 18 | 150 |

Unless otherwise described, the width, depth, and height of the housing body 10 are generally described with respect to the same orientation as shown as described with respect to the width, depth, and height of the embodiment of FIG. 2. Such dimensions may allow the same form-factor and packing benefits discussed above.

For another example, as shown in FIG. 17, in some embodiments the channel 20 may have a curved profile and may be dimensioned to receive at least four detonating cords, for example four standard-size detonating cords, for example in a two-by-two configuration (i.e., two rows of two detonating cords each). For example, the channel 20 of an embodiment—for example, one shown in FIG. 17—may have a profile shaped approximately as a square having side lengths between approximately 9 mm and approximately 13 mm, preferably between approximately 10 mm and approximately 12 mm, more preferably approximately 11 mm. In some such embodiments, these dimensions may allow the channel 20 to receive four standard-size detonating cords. In this embodiment, the channel width 21 and channel depth 22 may have a ration of approximately 1:1.

The dimensions of the housing body 10 may vary depending on the application. For example, with reference to FIG. 17, dimension ranges of the housing body 10 of some embodiments may include those ranges and specific dimensions shown in TABLE 3 below:

TABLE 3

| Approx. Width (mm) Range | Approx. Depth (mm) Range | Approx. Height (mm) Range |
|---|---|---|
| 12-35 | 12-35 | 75-300 |
| 13-30 | 13-25 | 95-200 |
| 15-27 | 15-22 | 115-160 |
| 22 | 18 | 125 |
| 25 | 18 | 125 |
| 22 | 18 | 150 |
| 25 | 18 | 150 |

Such dimensions may allow the same form-factor and packing benefits discussed above.

Figure 7A:
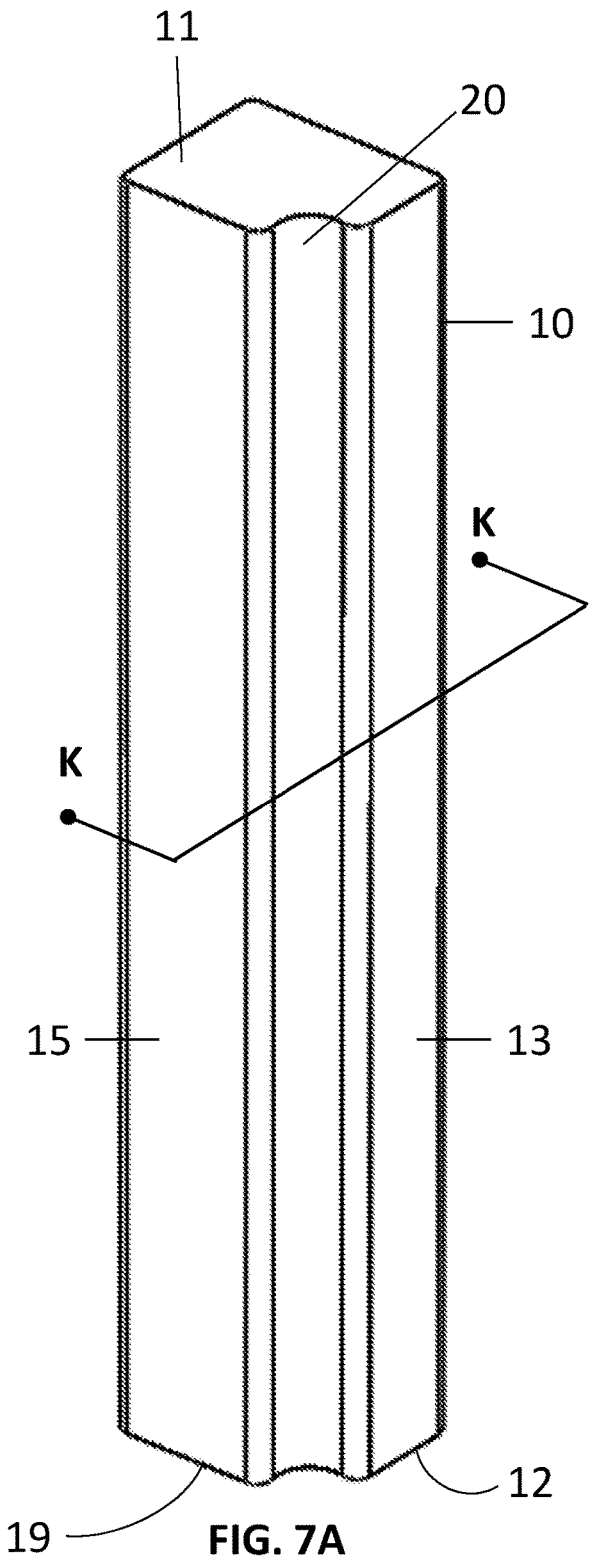
FIG. 7A is a perspective view of one embodiment of the compact energetic-breaching apparatus.
Figure 7B:
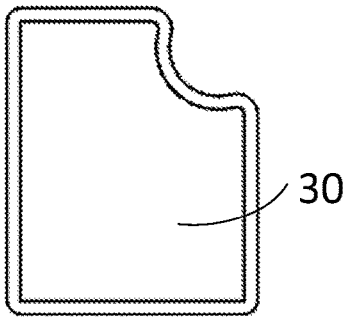
FIG. 7B is a cross section view of the embodiment of the compact energetic-breaching apparatus of FIG. 7A across line K-K.

For another example, as shown in FIG. 7, in some embodiments the channel 20 may have a curved profile and may be dimensioned to receive at least one detonating cord. This embodiment may have the channel 20 positioned on an edge 19 and may have the channel 20 be circular in shape. The channel 20 may be approximately a half-circle or approximately a quarter-circle. The dimensions of the channel 20 may be approximately similar to those described with respect to FIG. 2.

The dimensions of the housing body 10 may vary depending on the application. For example, with reference to FIG. 7, dimension ranges of the housing body 10 of some embodiments may include those ranges and specific dimensions shown in TABLE 4 below:

TABLE 4

| Approx. Width (mm) Range | Approx. Depth (mm) Range | Approx. Height (mm) Range |
|---|---|---|
| 10-35 | 10-35 | 75-300 |
| 12-30 | 12-25 | 95-200 |
| 15-27 | 15-22 | 115-160 |
| 22 | 18 | 125 |
| 25 | 18 | 125 |
| 22 | 18 | 150 |
| 25 | 18 | 150 |

Such dimensions may allow the same form-factor and packing benefits discussed above.

Figure 8A:
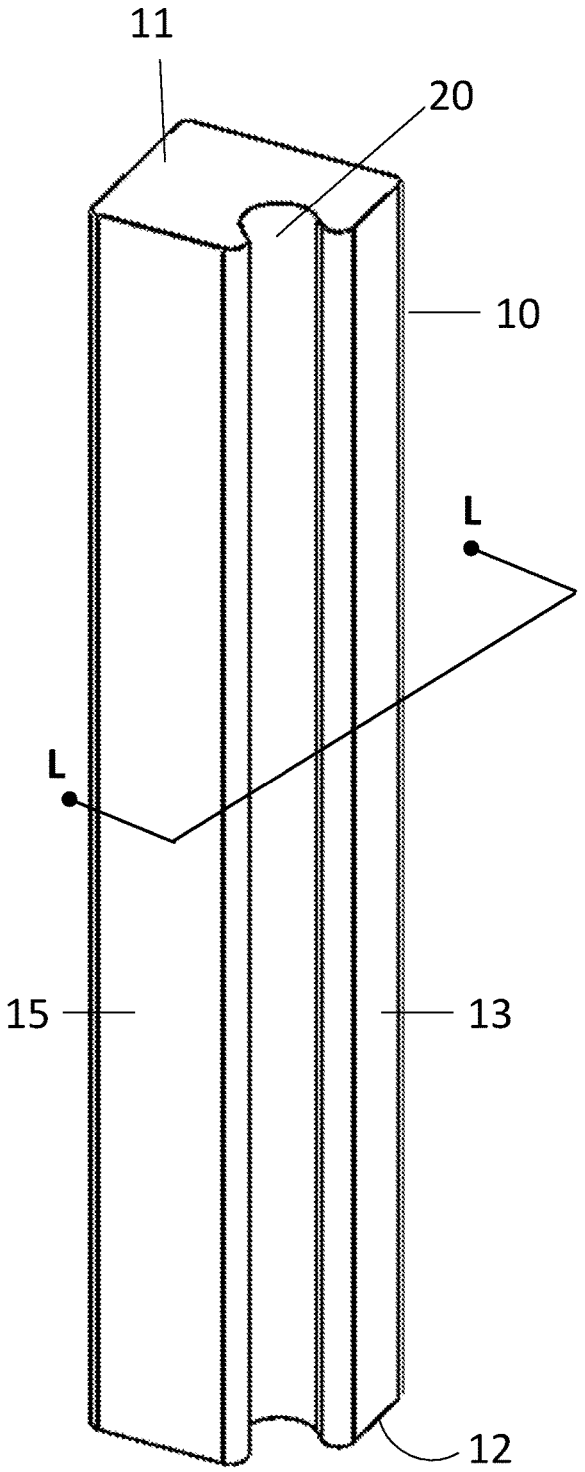
FIG. 8A is a perspective view of one embodiment of the compact energetic-breaching apparatus.
Figure 8B:
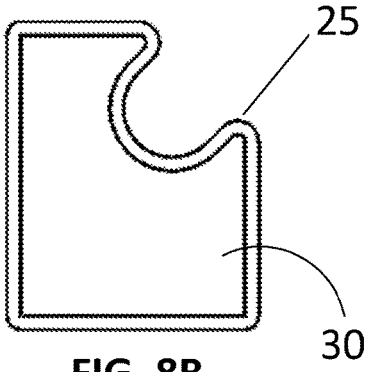
FIG. 8B is a cross section view of the embodiment of the compact energetic-breaching apparatus of FIG. 8A across line L-L.
Figure 9A:
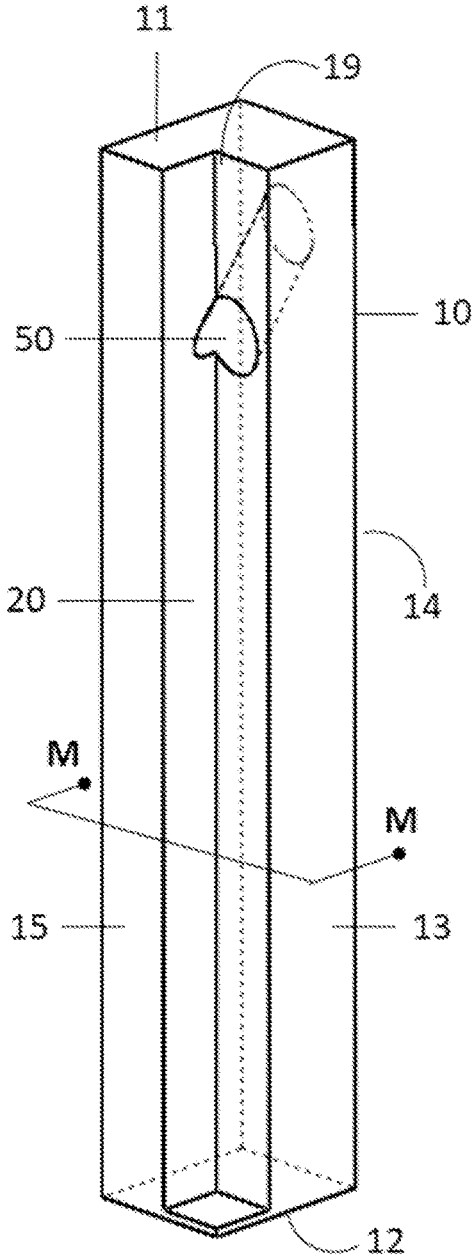
FIG. 9A is a front perspective view of one embodiment of the compact energetic-breaching apparatus.
Figure 9B:
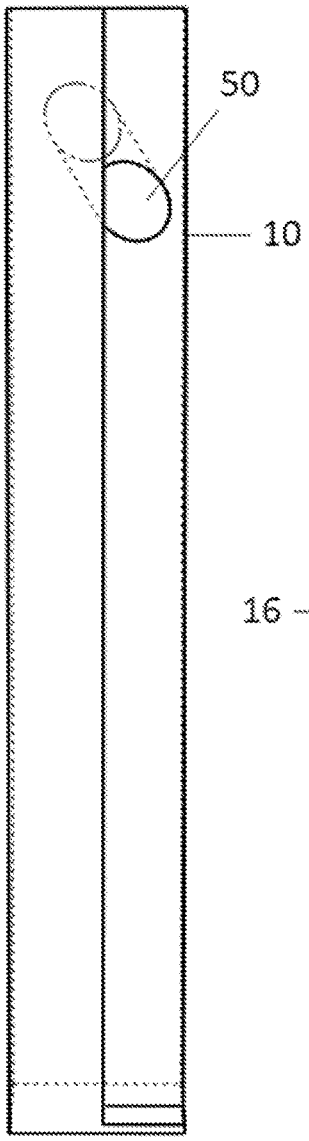
FIG. 9B is a front view of the embodiment of the compact energetic-breaching apparatus of FIG. 9A.
Figure 9C:
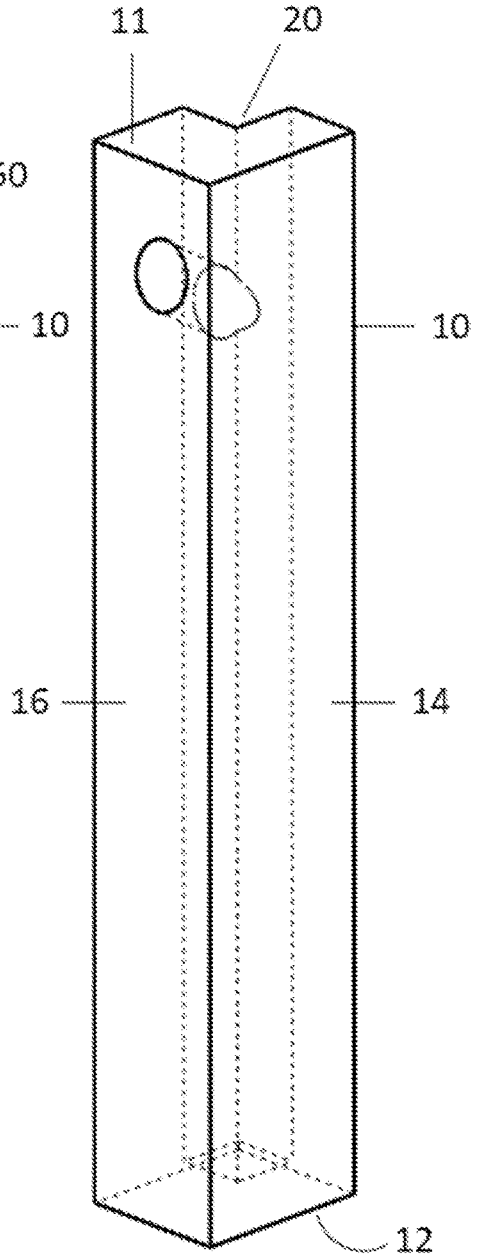
FIG. 9C is a back perspective view of the embodiment of the compact energetic-breaching apparatus of FIG. 9A.
Figure 9D:
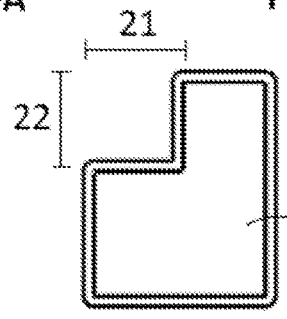
FIG. 9D is a cross section view of the embodiment of the compact energetic-breaching apparatus of FIG. 9A across line M-M.
Figure 10A:
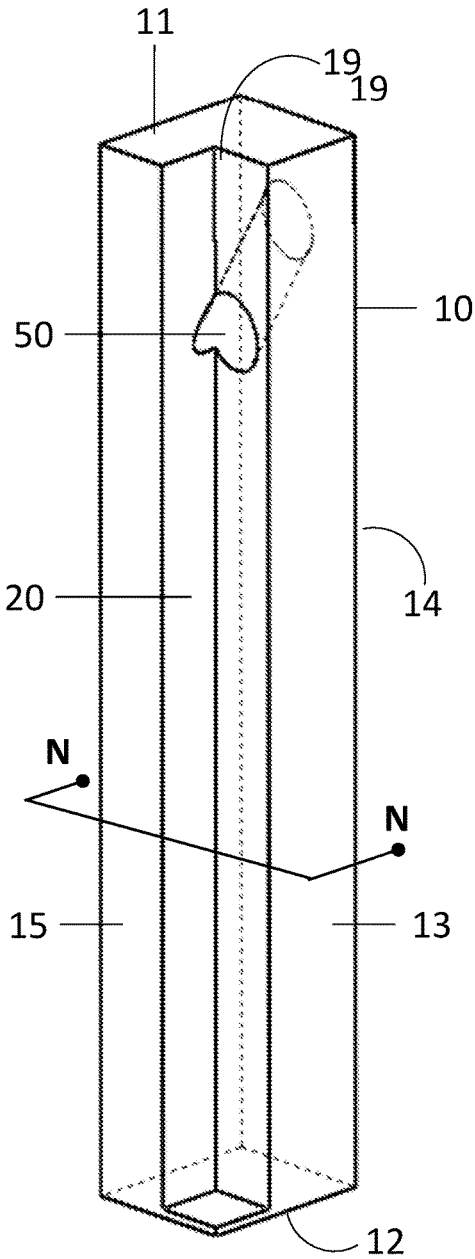
FIG. 10A is a front perspective view of one embodiment of the compact energetic-breaching apparatus.
Figure 10B:
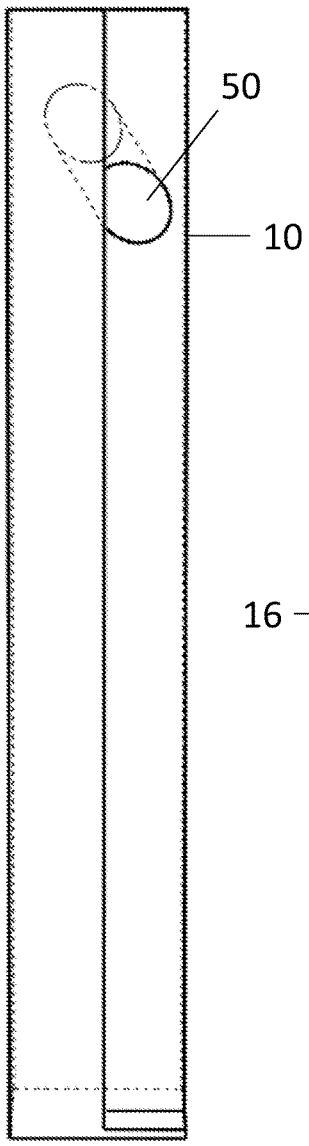
FIG. 10B is a front view of the embodiment of the compact energetic-breaching apparatus of FIG. 10A.
Figure 10C:
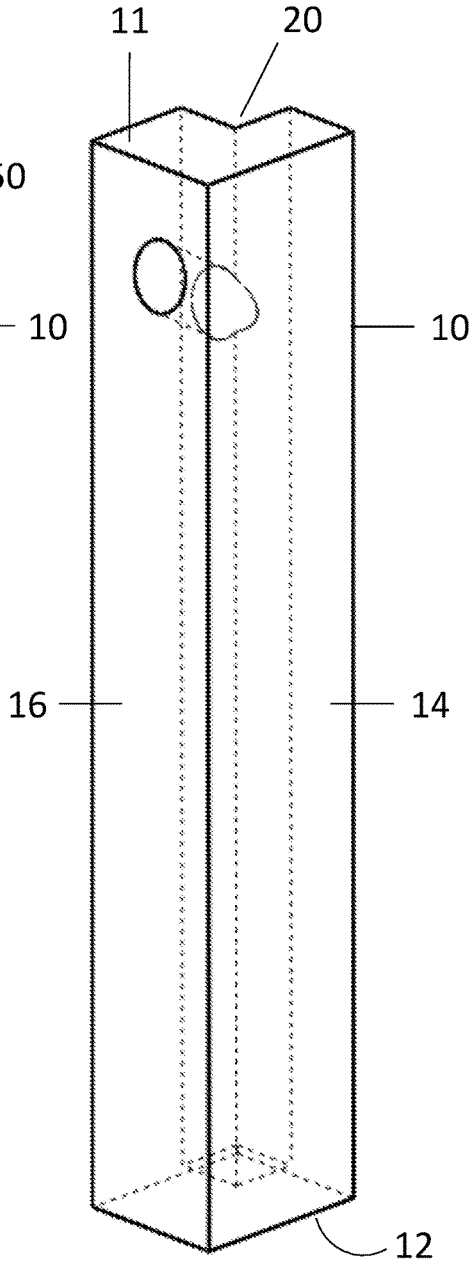
FIG. 10C is a back perspective view of the embodiment of the compact energetic-breaching apparatus of FIG. 10A.
Figure 10D:
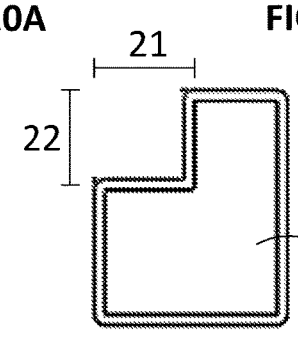
FIG. 10D is a cross section view of the embodiment of the compact energetic-breaching apparatus of FIG. 10A across line N-N.

For another example, as shown in FIG. 8, in some embodiments the channel 20 may have a curved profile dimensioned to receive at least two detonating cords. Like the embodiment shown in FIG. 7, the embodiment shown in FIG. 8 has the channel 20 positioned on an edge 19. The profile of the channel 20 may have the same sizes and proportions as described with respect to FIG. 3.

The dimensions of the housing body 10 may vary depending on the application. For example, with reference to FIG. 8, dimension ranges can be similar or identical to the ranges and dimensions discussed above with regard to FIG. 7 and TABLE 4. Such dimensions may allow the same form-factor and packing benefits discussed above.

In the embodiments shown in FIGS. 2, 3, 7, 8, 16, and 17, as examples, the channel 20 shape is shown as uniform across the entire length (or height) of the housing body. In other embodiments discussed below, the channel 20 may have different cross sections across different lengths.

In some embodiments, the channel 20 may have other shapes or other dimensions, for example to receive other detonating cords. Further, in some embodiments, the housing body 10 may have other shapes or other dimensions to accommodate other detonating cords or other energetic materials.

3.2 Channel—Profile with Straight Sections

In some embodiments—for examples, as shown in FIGS. 1, 2, 4, 9, and 10—the channel may have a profile with straight sections. For the sake of clarity, the reference to "straight sections" is with respect to the cross section of the channel 20, and not whether the channel 20 is straight along its length (or height). As used in this disclosure, "profile with straight sections" may include profiles which have only straight sections and profiles any section of which are straight despite also having curved sections. A channel 20 with straight sections may be either on a face (e.g., like in FIG. 4) or on an edge (e.g., like in FIGS. 9 and 10). In some embodiments, as shown in FIG. 4, the channel 20 with straight sections may either extend all the way from a first face to a second face. In other embodiments, the channel 20 may stop short of one or both faces, as shown in FIG. 9, in which the channel 20 extends through a first face but only almost to a second face. In some embodiments in which the channel 20 has a profile with straight sections, as shown for example in FIG. 4, the channel 20 may be shaped to receive a plastic explosive—for example, a moldable explosive or a sheet explosive.

For example, the channel 20 of an embodiment—for example, one shown in FIG. 4—may have: (1) a channel width 21 between approximately 4 mm and approximately 12 mm, preferably between approximately 4.5 mm and approximately 10 mm (for examples, approximately 4.8 mm, approximately 6.9 mm, approximately 8.35 mm, or approximately 9.5 mm); and (2) a channel depth 22 between approximately 4 mm and approximately 12 mm, preferably between approximately 4.5 mm and approximately 10 mm (for examples, approximately 4.8 mm, approximately 6.9 mm, approximately 8.35 mm, or approximately 9.5 mm). The ratio of the channel width 21 to the channel depth 22 can be 1:1.

The dimensions of the housing body 10 may vary depending on the application. For example, with reference to FIG. 4, dimension ranges can be similar or identical to the ranges and dimensions discussed above with regard to FIG. 7 and TABLE 4. Such dimensions may allow the same form-factor and packing benefits discussed above. In some embodiments in which the channel 20 has a profile with straight sections, as shown for examples in FIGS. 1 and 3, the channel 20 may be shaped to receive at least one detonating cord.

One exemplary embodiment is shown in FIG. 1. The embodiment in FIG. 1 may have: (1) a channel width 21 between approximately 5 mm and approximately 9 mm, preferably between approximately 6 mm and approximately 8 mm, more preferably approximately 7.5 mm; and (2) a channel depth 22 between approximately 5 mm and approximately 9 mm, preferably between approximately 6 mm and approximately 8 mm, more preferably approximately 7.5 mm. The dimensions of the housing body 10 may vary depending on the application. For example, with reference to FIG. 1, dimension ranges can be similar or identical to the ranges and dimensions discussed above with regard to FIG. 7 and TABLE 4. Such dimensions may allow the same form-factor and packing benefits discussed above.

3.3 Channel—V-Shaped Profile

In some embodiments—for examples, as shown in FIGS. 5, 12, and 13—a portion of the channel 20 may have a V-shaped profile. In embodiments in which a portion of the channel 20 has a V-shaped profile, the channel 20 may be shaped to receive a plastic explosive—for example, a sheet explosive 120.

For example, the channel 20 of an embodiment—for example, one shown in FIG. 5—may have a V-shaped profile wherein the two sides of the V-shape each have a channel side length 24 between approximately 8 mm and approximately 20 mm, preferably between approximately 10 mm and approximately 15 mm, more preferably approximately 12.5 mm.

The dimensions of the housing body 10 may vary depending on the application. For example, with reference to FIG. 5, dimension ranges can be similar or identical to the ranges and dimensions discussed above with regard to FIG. 7 and TABLE 4. Such dimensions may allow the same form-factor and packing benefits discussed above.

3.4 Channel—Channel Lip

In some embodiments—as shown for examples at least in FIGS. 1, 3, 8, and 12—the channel 20 of the body of a compact energetic-breaching apparatus may further comprise a channel lip 25. In some embodiments—as shown for examples in FIGS. 1 and 8—a channel lip 25 may be a protrusion of the housing body 10 over the channel 20 for retaining energetic material, for example a detonation cord. In some embodiments—as shown for example in FIG. 12—a channel lip 25 may be a protrusion of the housing body 10 over the channel 20 for retaining a liner 70 (detailed below). Many different embodiments of the channel 20 of a compact energetic-breaching apparatus may comprise a channel lip 25; however, for clarity, not all drawings depict a channel lip 25. In some embodiments—as shown for example in FIG. 3—a channel lip 25 may be a slanting of the profile of the channel 20 that narrows the profile of the channel 20 at the face on which the channel 20 is positioned, for example the third face (for example, as shown in FIG. 3, the front face 13).

3.5 Channel—Summary of the Three Channel Types

In different embodiments, the channel 20 may be shaped and dimensioned differently for different applications. In particular, in some embodiments, the channel 20 may be shaped and dimensioned differently to receive different energetic materials. For example, a channel 20 having a curved profile—as shown for examples in FIGS. 1, 2, 3, 6, 7, 8, 11, 14, 15, and 17—may be shaped and dimensioned to receive at least one detonating cord, for example standard-size detonating cord. In such an embodiment, the channel 20 having a curved profile may be shaped and dimensioned such that the radius of curvature of the curved sections substantially fits the shape and dimension of a detonating cord, for example a detonating cord with a diameter between approximately 3 mm and approximately 8.25 mm. Some examples of detonating cord which may fit well with some embodiments include 50-grains-per-foot detonating cord with a diameter of approximately 5 mm, 25-grains-per-foot detonating cord with a diameter of approximately 4.5 mm, and 100-grains-per-foot detonating cord with a diameter of approximately 6 mm.

In addition or alternatively, a channel 20 having a profile with straight sections—as shown for examples in FIGS. 4 and 9—may be shaped and dimensioned to receive a plastic explosive, for example a moldable explosive (such as, for examples, C4, PE-4, Semtex, putty explosive, or other moldable explosive). In such an embodiment, the channel 20 having a profile with straight sections may be shaped and dimensioned to facilitate packing of the plastic explosive into the channel 20. In addition or alternatively, a channel 20 having a V-shaped profile—as shown for examples in FIGS. 5, 10, 12, and 13—may be shaped and dimensioned to receive a plastic explosive, for example sheet explosive 120 (such as, for examples Primasheet, SX2, Detasheet, PETN-based sheet explosive, RDX-based sheet explosive, or other sheet explosive). In such an embodiment, the channel 20 having a V-shaped profile may be shaped and dimensioned to facilitate packing of the plastic explosive into the channel 20. Some examples of sheet explosive which may fit well with some embodiments include C-1 sheet explosive with a thickness of approximately 1 mm, C-1.5 sheet explosive with a thickness of approximately 1.5 mm, and C-2 sheet explosive with a thickness of approximately 2 mm. Other embodiments may accommodate sheet explosives having other thickness, for example C-8 sheet explosive with a thickness of approximately 8 mm or RDX-based sheet explosive with a thickness between approximately 3.2 mm and approximately 7.4 mm.

4. Priming Pocket

In some embodiments—as shown, for examples, in FIGS. 1, 5, 6, 11, 12, 13, and 15—the channel 20 of a compact energetic-breaching apparatus may further comprise a priming pocket 40 for receiving at least one detonator, for example a commercially available blasting cap.

In some embodiments, as shown for example in FIG. 1, the channel 20 may have a priming pocket 40 portion (FIG. 1B) over a first length (comprised of the channel 20 plus the priming pocket 40) and a basic channel 20 portion (FIG. 1C) over a second length. The length of the priming pocket 40 portion (as measured over the height of the body) is preferably between approximately 25 mm and approximately 85 mm, and more preferably between approximately 40 mm and approximately 70 mm, for example 55 mm. For illustration, compare the cross section view in FIG. 1B with that in FIG. 1C.

In some embodiments, as shown for example in FIG. 1, the priming pocket 40 may extend through at least one face, for example the first face or the second face. In some embodiments, as shown for example in FIG. 1, the priming pocket 40 may extend through the top face 11. In some embodiments—for examples, the embodiments shown in FIGS. 1 and 6—the priming pocket 40 may be a deepening of the channel 20 over a portion of the channel 20. In some embodiments, that shown in FIG. 6 for example, the priming pocket 40 may be a deepening of a channel 20 having a curved profile; for illustration, compare the cross section view in FIG. 6B with that in FIG. 6C. In some embodiments, that shown in FIG. 1 for example, the priming pocket 40 may be a deepening of a channel 20 having a profile with straight sections; for illustration, compare the cross section view in FIG. 1B with that in FIG. 1C. In some embodiments, as shown for example in FIG. 1, the priming pocket 40 may be shaped and dimensioned to receive at least one detonator 150, for example a commercially available blasting cap. For example, the priming pocket 40 of the embodiment shown in FIG. 1 may have a curved profile and may extend deeper than channel 20 by between approximately 6 mm and approximately 9 mm, preferably between approximately 6.5 mm and approximately 8.5 mm, more preferably between approximately 7.5 mm and 8 mm. In some embodiments, as shown for examples in FIGS. 1, 5, and 11, the priming pocket 40 may have a priming pocket length 41 that is between approximately 20 mm and approximately 70 mm, and preferably between approximately 30 mm and approximately 60 mm, for example 40 mm. Again, when referring to the length of the channel 20, it is measured along the height of the housing body 10. In some embodiments, the priming pocket 40 may have other shapes or other dimensions, to receive other detonators.

As shown in the figures, the channel 20 may have varying profiles across the height. For example, the embodiment in FIG. 1 has a channel 20 profile shown in FIG. 1B across a first length and a channel 20 profile shown in FIG. 1C across a second length.

Figure 5A:
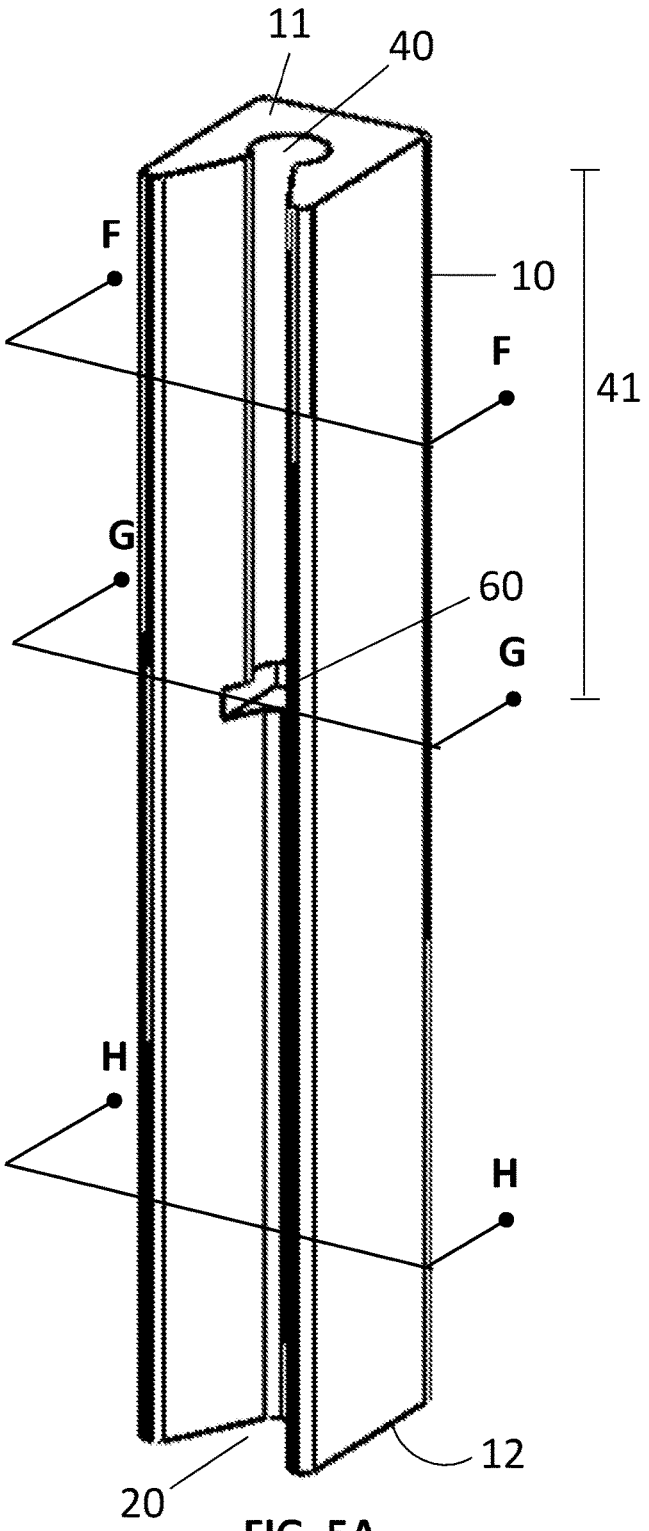
FIG. 5A is a perspective view of one embodiment of the compact energetic-breaching apparatus.
Figure 5B:
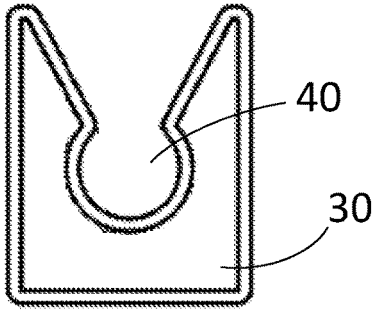
FIG. 5B is a cross section view of the embodiment of the compact energetic-breaching apparatus of FIG. 5A across line F-F.
Figure 5C:
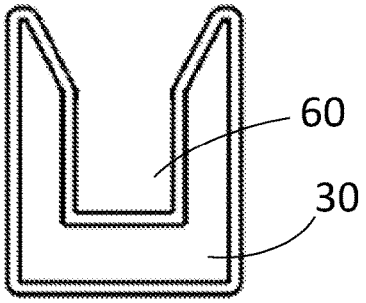
FIG. 5C is a cross section view of the embodiment of the compact energetic-breaching apparatus of FIG. 5A across line G-G.
Figure 5D:
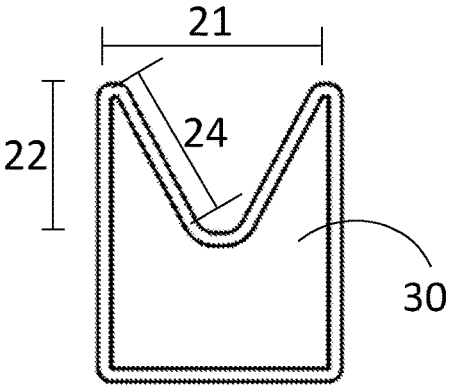
FIG. 5D is a cross section view of the embodiment of the compact energetic-breaching apparatus of FIG. 5A across line H-H.
Figure 5E:
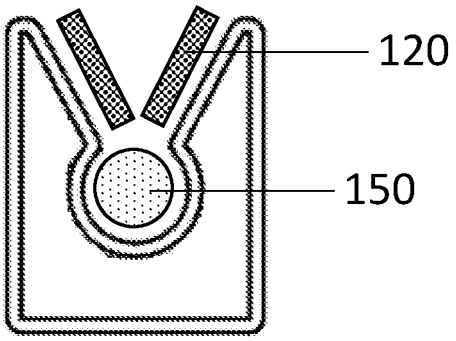
FIG. 5E is a cross section view of the embodiment of the compact energetic-breaching apparatus of FIG. 5A across line F-F showing a placement of energetic material and detonator.
Figure 5F:
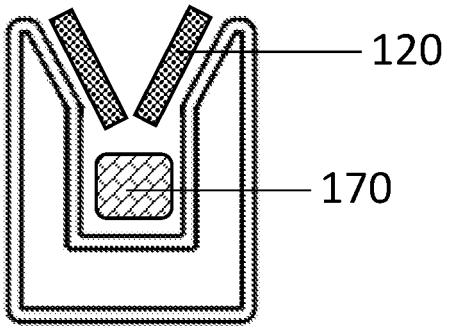
FIG. 5F is a cross section view of the embodiment of the compact energetic-breaching apparatus of FIG. 5A across line G-G showing a placement of energetic material and booster.
Figure 5G:
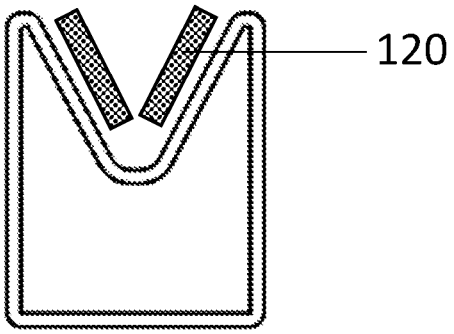
FIG. 5G is a cross section view of the embodiment of the compact energetic-breaching apparatus of FIG. 5A across line H-H showing a placement of energetic material.
Figure 6A:
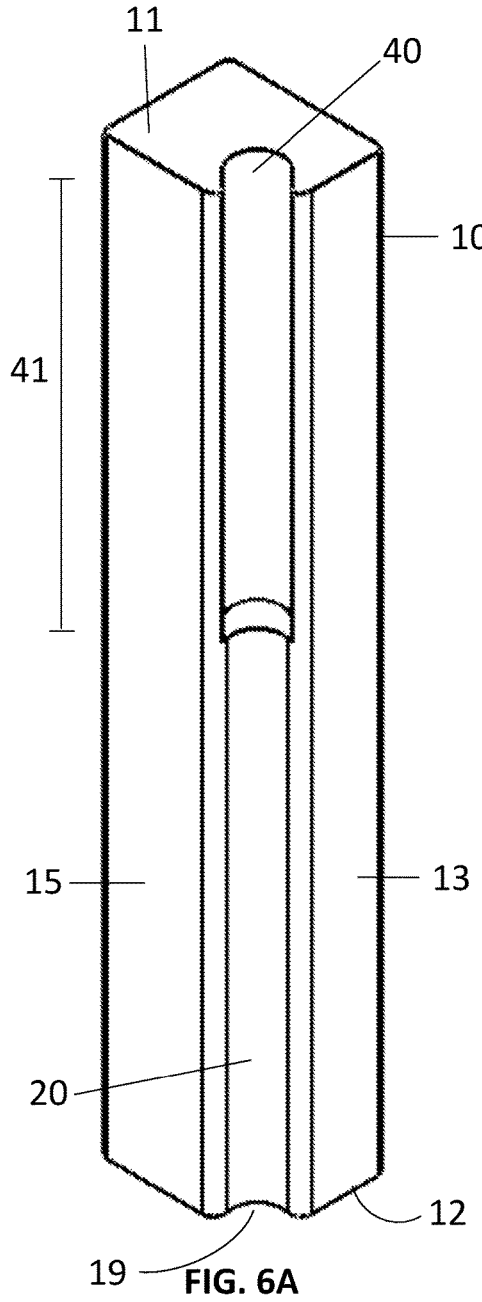
FIG. 6A is a front perspective view of one embodiment of the compact energetic-breaching apparatus.
Figure 6B:
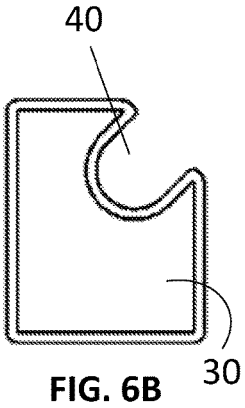
FIG. 6B is a cross section view of the embodiment of the compact energetic-breaching apparatus of FIG. 6D across line I-I.
Figure 6C:
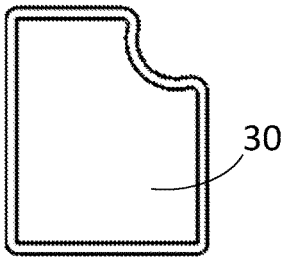
FIG. 6C is a cross section view of the embodiment of the compact energetic-breaching apparatus of FIG. 6D across line J-J.
Figure 6D:
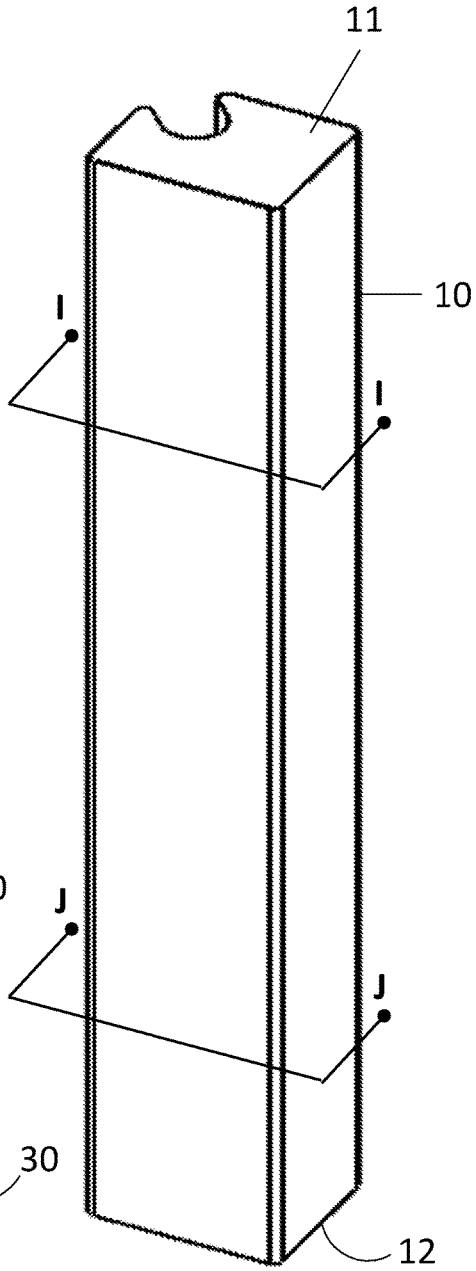
FIG. 6D is a back perspective view of the embodiment of the compact energetic-breaching apparatus of FIG. 6A.

In embodiments having a channel 20 with a V-shaped profile, the priming pocket 40 may be positioned along the channel 20 and adjacent to the vertex of the V-shape; for illustration, compare the cross section view in FIG. 5B with that in FIG. 5D. In such embodiments, shown for example in FIG. 5, the priming pocket 40 may be shaped and dimensioned to receive at least one detonator 150, for example a commercially available blasting cap. For example, the priming pocket 40 of an embodiment—for example, one shown in FIG. 5B—may have a curved profile and may extend the main channel 20 (shown in FIG. 5D) by between approximately 6 mm and approximately 9 mm, preferably between approximately 6.5 mm and approximately 8.5 mm, more preferably between approximately 7.5 mm and 8 mm. In some embodiments, the priming pocket 40 may have other shapes or other dimensions, to receive other detonators.

5. Booster Pocket

In some embodiments—as shown, for examples, in FIGS. 5, 12, and 13—the channel 20 of a compact energetic-breaching apparatus may further comprise a booster pocket 60 for receiving at least one explosive booster 170. Such an explosive booster might be, for examples, a piece of plastic explosive, a piece of moldable explosive, a piece of sheet explosive, or another explosive booster.

In some embodiments, as shown for example in FIG. 5, the channel 20 may have a priming pocket 40 portion (FIG. 5B) over a first length, a booster pocket 60 portion (FIG. 5C) over a second length and the basic channel 20 portion (FIG. 5D) over a third length. As shown in this embodiment, the booster pocket 60 portion is positioned between and adjacent to the priming pocket 40 portion and basic channel 20 portion. The length of the booster pocket 60 portion (as measured over the height of the body) is preferably either between approximately 2 mm and approximately 5 mm (for example, as shown in FIG. 12, approximately 3 mm) or between approximately 8 mm and approximately 12 mm (for example, as shown in FIG. 13, approximately 10 mm). For illustration, compare the cross section view in FIG. 5C with those in FIGS. 5B and 5D.

In some embodiments, as shown for example in FIG. 5, the booster pocket 60 may be shaped and dimensioned to receive at least one explosive booster 170, such as a piece of plastic explosive, a piece of moldable explosive, a piece of sheet explosive, or another explosive booster. For example, the booster pocket 60 of an embodiment—for example, one shown in FIG. 5—may be shaped approximately as a cuboid as shown in the figures and may—over a length of the main channel 20 between approximately 2 mm and approximately 5 mm, preferably approximately 3 mm—widen the main channel 20 (shown in FIG. 5D) to a width between approximately 6 mm and approximately 8 mm, preferably approximately 7.5 mm to a depth beyond the apex of the main channel 20 between approximately 8 mm and approximately 12 mm, preferably approximately 10 mm. In some embodiments, as shown for example in FIG. 13, the booster pocket 60 may have other shapes or other dimensions. The width, depth, and height of the booster pocket 60 are generally described with respect to the same orientation as shown and described with respect to the width 31, depth 32, and height 33 of the housing body 10, for example as described with respect to the width 31, depth 32, and height 33 of the housing body 10 of the embodiment of FIG. 2 above.

Another example of a booster pocket 60 is shown in FIG. 13. In this embodiment, the booster pocket 60 may be shaped as shown in FIG. 13 and may may—over a length of the main channel 20 between approximately 8 mm and approximately 12 mm, preferably approximately 10 mm—widen the main channel 20 (shown in FIG. 13D) to a width between approximately 5 mm and approximately 10 mm, preferably approximately 7.5 mm to a depth beyond the apex of the main channel 20 between approximately 3 mm and approximately 7 mm, preferably approximately 5 mm. In some embodiments, the booster pocket 60 may have other shapes or other dimensions to receive other explosive boosters.

6. Priming Through Hole

In some embodiments—as shown, for examples, in FIGS. 4, 9, and 10—a compact energetic-breaching apparatus may further comprise—either in addition to or instead of a priming pocket 40—a priming through hole 50 for receiving at least one detonator, for example a commercially available blasting cap. In some embodiments, as shown for example in FIG. 4, the priming through hole 50 may extend from the channel 20 to at least one face, for example the back face 14. In some embodiments with a priming through hole 50, the channel 20 may also comprise a booster pocket 60. For examples, any of the FIGS. 4, 9, and 10 could further comprise a booster pocket 60, though for clarity no booster pocket 60 is shown on these figures. It should further be noted that the embodiments and figures showing a priming through hole 50 may also be used without the priming through hole 50. As an example, these types of embodiments could prime from the top like many of the other disclosed embodiments.

In some embodiments, as shown for example in FIG. 4, the priming through hole 50 may be shaped and dimensioned to receive at least one detonator, for example a commercially available blasting cap. For example, the priming through hole 50 of an embodiment—for example, one shown in FIG. 4—may have a curved profile which is substantially circular. The priming through hole 50 may have a priming through hole diameter 51 between approximately 6 mm and approximately 9 mm, preferably between 6.5 mm and 8.5 mm, more preferably between 7.5 mm and 8 mm. In some embodiments, the priming through hole may have a priming through hole length 52 of between approximately 5 mm and approximately 30 mm, preferably between approximately 10 mm and approximately 20 mm, for example 15 mm. In some embodiments, the priming through hole 50 may have other shapes or other dimensions, to receive other detonators.

7. Liner

In some embodiments—as shown, for examples, in FIGS. 11 and 13—a compact energetic-breaching apparatus may further comprise a liner 70. The embodiment shown in FIG. 12 could also be used with a liner 70, placed similarly to that shown in FIG. 13. The liner 70 may be made of any suitable material. For example, in some embodiments the liner 70 may be made of any suitable metal—such as aluminum, copper, or other suitable metal—to form a cutting jet (for example, through the Munroe effect, by collapsing or melting) upon detonation of the energetic material. The liners 70 that form a cutting jet upon detonation are referred to here as a "cutting jet liner."

In some embodiments, the liner 70 may be made of any suitable polymeric material. In some embodiments the liner 70 may be press-fit into position in the compact energetic-breaching apparatus. In some such embodiments, the liner 70 may be press-fit or snap-fit into position before any energetic material has been inserted. In other embodiments, the liner 70 may be press-fit or snap-fit into position after inserting some or all energetic material. The channel 20 may have ridges, protrusions, or other commonly implemented structures to facilitate the liner 70 being able to be press-fit or snap-fit into place.

In some embodiments, the liner 70 may have a V-shaped profile, as shown for example in FIG. 13. In some embodiments, as shown for example in FIG. 13, the liner 70 may be positioned within the channel 20. In some embodiments, as shown for example in FIG. 13, the liner 70 may be positioned and oriented within the channel 20 so as to contact or substantially contact the energetic material—e.g., detonating cord, plastic explosive, moldable explosive, sheet explosive, or other energetic material—around the reflex angle 75 of the liner 70. In some embodiments the size of the reflex angle 75 is between approximately 275 degrees and approximately 330 degrees, preferably between approximately 290 degrees and 315 degrees. The V-shaped channels shown in other embodiments may have similar reflex angles.

In some embodiments with a liner, the channel may have a curved profile shaped and dimensioned to receive at least two detonating cords, for example four detonating cords as shown in FIG. 11. For example, the channel 20 may have a width, as measured at the widest part, of between approximately 10 mm and approximately 30 mm, preferably between approximately 15 mm and approximately 25 mm, and preferably approximately 20 mm.

In some embodiments, the liner 70 may have any other shape suitable for forming a cutting jet upon detonation. In some embodiments, the liner 70 may have any other shape suitable to take advantage of the colliding-shockwave effect by focusing or increasing the blast effect.

8. Pushing Embodiments

In some embodiments, the aspect ratio of the housing body 10 may be different from that generally discussed in the foregoing. For example, in some embodiments—as shown, for example, in FIG. 14 and looking at the bottom face 12 in FIG. 14A—the housing body 10 may be both wider and deeper than it is tall. Such an embodiment could be used, for instance, to spread the force of an exploding detonating cord over a larger surface area. This disclosure refers to such embodiments as "pushing" embodiments. In some pushing embodiments, as shown for example in FIG. 14, the dimensions of the housing body 10 may vary depending on the application. For example, with reference to FIG. 14, dimension ranges of some embodiments may include those ranges and specific dimensions shown in TABLE 5 below:

TABLE 5

| Approx. Width (mm) Range | Approx. Depth (mm) Range | Approx. Height (mm) Range |
|---|---|---|
| 50-150 | 25-300 | 10-50 |
| 55-125 | 100-250 | 12-40 |
| 60-100 | 125-200 | 14-30 |
| 66 | 150 | 16 |
| 66 | 150 | 22 |
| 80 | 150 | 16 |
| 80 | 150 | 25 |

Such dimensions may allow the same form-factor and packing benefits discussed above.

In some pushing embodiments, the channel 20 may wend around a face, for example the second face. As shown for example in FIG. 14, in some pushing embodiments, the channel 20 may wend around the bottom face 12. In some pushing embodiments, as shown for example in FIG. 14, the channel 20 may be spiral-shaped. In other pushing embodiments, the channel 20 may have other shapes, for example star-shape, gridiron-shape, meander-shape, or other shape suitable for distributing a length of energetic material (for example, detonating cord, plastic explosive, moldable explosive, sheet explosive, or other energetic material) over a face, for example the bottom face 12. In some pushing embodiments, the channel 20 may further comprise an entrance through hole 29.

In some pushing embodiments, as shown in FIG. 14, the channel 20 may be shaped and dimensioned to receive at least one detonating cord, for example a standard-size detonating cord. For example, the channel 20 of an embodiment—for example, one shown in FIG. 14—may have a channel width 21, a channel depth 22, and an overall channel length. The dimensions of the channel 20 may vary depending on the application. For example, with reference to FIG. 14, dimension ranges of some embodiments of the channel 20 may include those ranges and specific dimensions shown in TABLE 6 below:

TABLE 6

| Approx. Width (mm) Range | Approx. Depth (mm) Range | Approx. Height (mm) Range |
|---|---|---|
| 3-10 | 3-10 | 500-1500 |
| 4-8 | 4-8 | 600-1375 |
| 5 | 5 | 800 |
| 5 | 5 | 1200 |

Such dimensions may allow the channel 20 to receive a standard-size detonating cord. The entrance through hole 29 may have a similar width and depth as the rest of the channel 20.

In some pushing embodiments, as shown for example in FIG. 14, the channel 20 may have shapes with only gentle curves and straight portions. In such a pushing embodiment, gentle curves may allow for easier threading of one or more detonating cords through the channel 20. In other pushing embodiments, the channel 20 may have other shapes or other dimensions, to receive other energetic material.

Figure 20A:
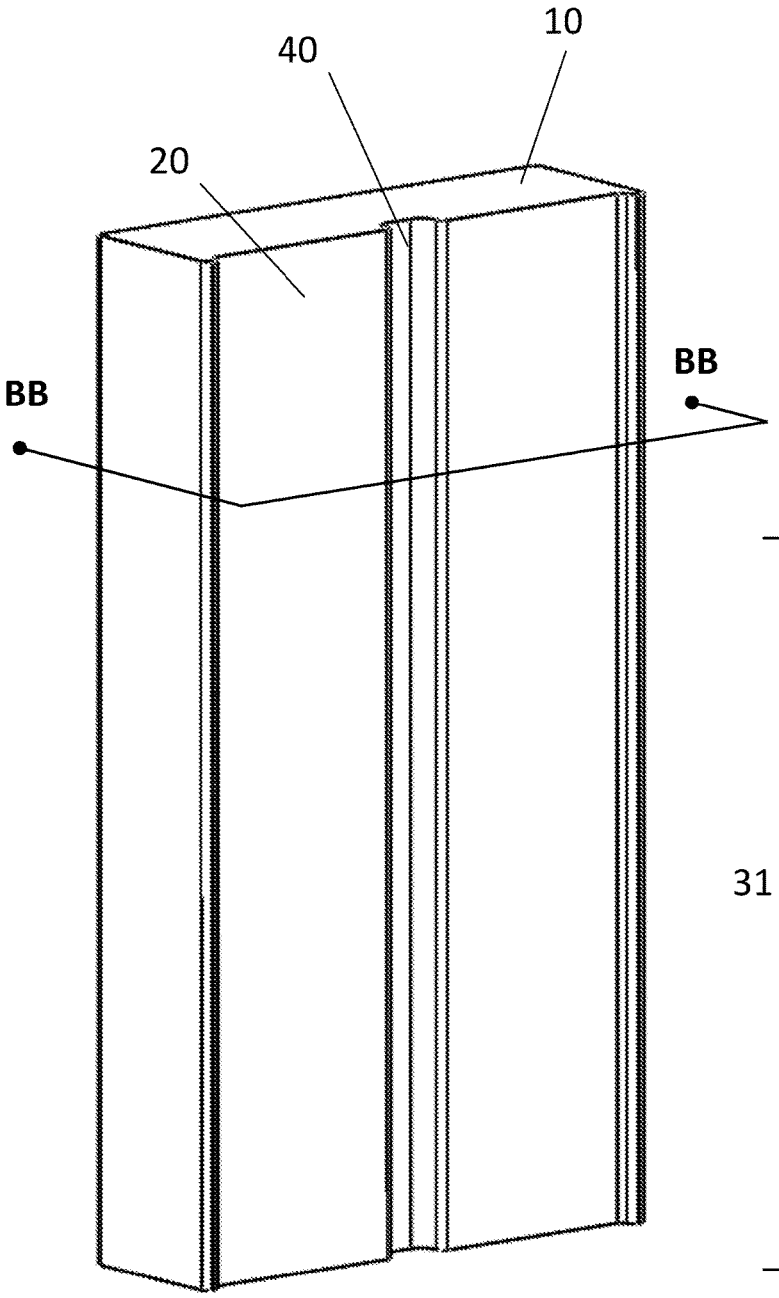
FIG. 20A is a front perspective view of one embodiment of the compact energetic-breaching apparatus.
Figure 20B:
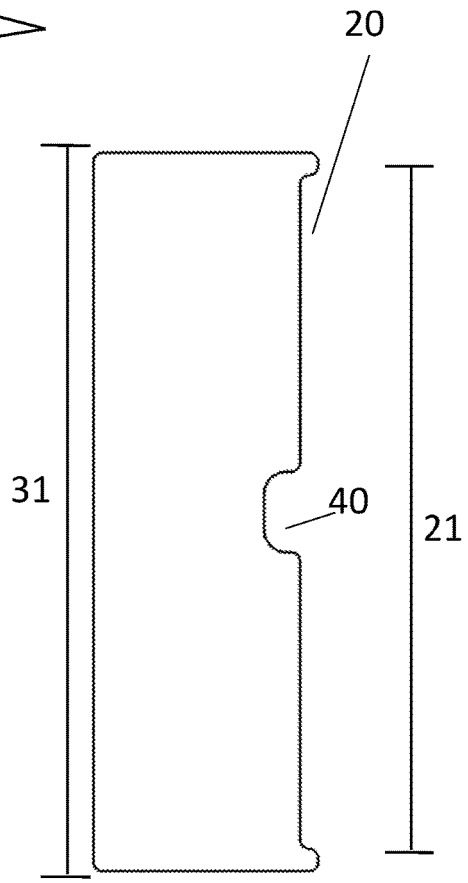
FIG. 20B is a cross section view of the embodiment of the compact energetic-breaching apparatus of FIG. 20A across line BB-BB.

In some pushing embodiments, as shown for example in FIG. 20, the channel 20 may spread over substantially all of a face. For example, as shown in FIG. 20, the channel 20 may have a channel width 21 that is similar to the housing body width 31. In such a pushing embodiment, the channel 20 may be shaped and dimensioned to receive a sheet explosive. For example, as shown in FIG. 20, the channel 20 may have a channel depth 22 between approximately 1 mm and approximately 8 mm, for example, approximately 2 mm. In some pushing embodiments, the channel 20 may also comprise a priming pocket 40. The priming pocket 40 may be shaped and dimensioned to receive a detonator, for example at least one detonating cord. As shown in FIG. 20, the priming pocket 40 portion may have a curved profile, may be a deepening of the channel 20, may extend substantially the entire height of the housing body 10, and may extend deeper than the channel 20 by approximately 4 mm deep from the bottom of the channel and be approximately 10 mm wide (e.g., to receive two detonating cords).

In some pushing embodiments, a compact energetic-breaching apparatus may further comprise a push plate 90, an example of which is shown in FIG. 14D. In some pushing embodiments, the push plate 90 may be made of rubber, carbon material, magnetic material, or any other suitable material. In some pushing embodiments, the push plate 90 may be affixed to a face, for example the bottom face 12. In some pushing embodiments, as shown for example in FIG. 14, the push plate 90 may have the same width and depth as the housing body 10. In some pushing embodiments, the push plate 90 may help to distribute to the target the force from the detonation. In some embodiments, no push plate 90 is used. Any pushing embodiment may be utilized without a push plate 90, for example to achieve a broader blast effect. For example, some pushing embodiments may be linked together to breach a wall, to destroy an improvised explosive device (IED) or other unexploded ordnance (UXO) (in what is sometimes called a 'drop charge'), or to create a 'cover port' by blowing open a hole in a wall just big enough to shoot through.

Figure 15A:
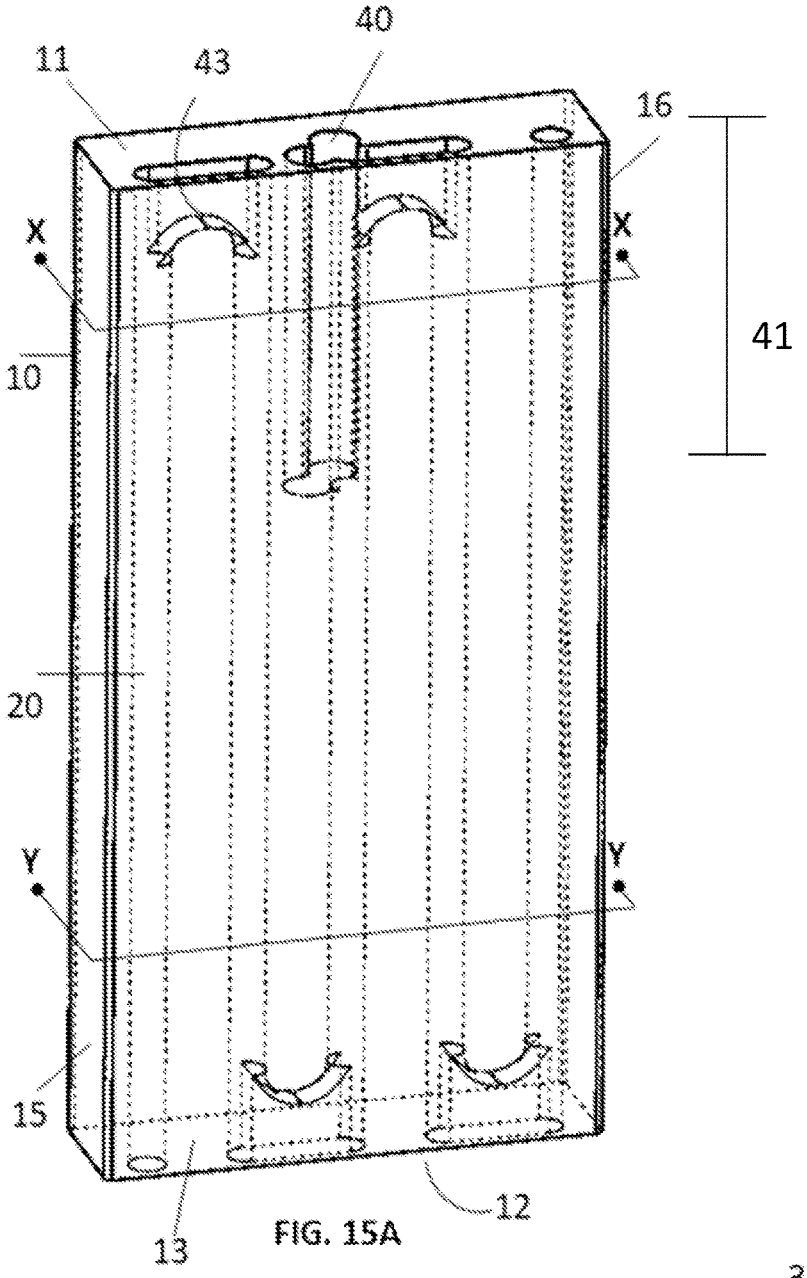
FIG. 15A is a front perspective view of one embodiment of the compact energetic-breaching apparatus.
Figure 15B:
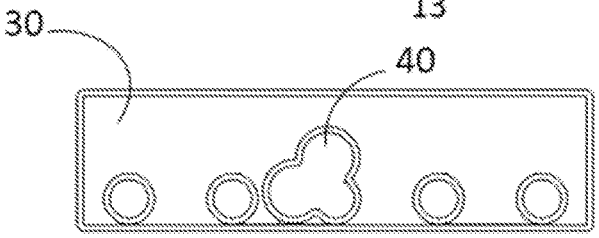
FIG. 15B is a cross section view of the embodiment of the compact energetic-breaching apparatus of FIG. 15A across line X-X.
Figure 15C:
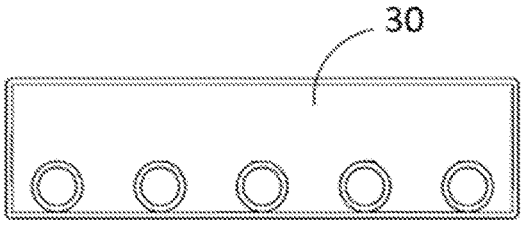
FIG. 15C is a cross section view of the embodiment of the compact energetic-breaching apparatus of FIG. 15A across line Y-Y.

In some pushing embodiments, the channel 20 may wend around substantially within the housing body 10. As shown for example in FIG. 15, in some embodiments, the channel may wend around substantially within the housing body 10 between the top face 11 and the bottom face 12. As shown for example in FIG. 15, the channel 20 may in some pushing embodiments have one or more bends 43. Further, in some pushing embodiments, for example as is shown in FIG. 15, the channel 20 may breach at least one face—for example, as shown in FIG. 15, the top face 11 or the bottom face 12—at a bend 43. In some such pushing embodiments, the breach of the face (for example, the top face 11 or the bottom face 12) by the channel 20 at a bend 43 may allow for easier threading of one or more detonating cords through the channel 20.

In some such embodiments, as shown for example in FIG. 15, the dimensions of the housing body 10 may vary depending on the application. For example, with reference to FIG. 15, dimension ranges of some embodiments may include those ranges and specific dimensions shown in TABLE 7 below:

TABLE 7

| Approx. Width (mm) Range | Approx. Depth (mm) Range | Approx. Height (mm) Range |
|---|---|---|
| 50-150 | 10-50 | 75-300 |
| 55-125 | 12-40 | 100-250 |
| 60-100 | 14-30 | 125-200 |
| 66 | 16 | 150 |
| 66 | 22 | 150 |
| 80 | 16 | 150 |
| 80 | 25 | 150 |

Such dimensions may allow the same form-factor and packing benefits discussed above.

In some pushing embodiments, as shown for example in FIG. 15, a priming pocket 40 may be used. For example, the priming pocket 40 of the embodiment shown in FIG. 15 may be shaped and dimensioned to receive two detonators, for example two commercially available blasting caps. For further clarification of this example, the priming pocket 40 of the embodiment shown in FIG. 15 may have a curved profile and may extend the channel 20 on each side by between approximately 6 mm and approximately 9 mm, preferably between approximately 6.5 mm and approximately 8.5 mm, more preferably between approximately 7.5 mm and 8 mm. In some embodiments, as shown for example in FIG. 15, the priming pocket 40 may have a priming pocket length 41 that is between approximately 20 mm and approximately 70 mm, and preferably between approximately 25 mm and approximately 45 mm. In some embodiments, the priming pocket 40 may have other shapes or other dimensions, to receive other detonators. In some pushing embodiments with a channel 20 substantially within the housing body 10, a compact energetic-breaching apparatus may further comprise a push plate 90, such as was described with respect to FIG. 14.

Figure 18A:
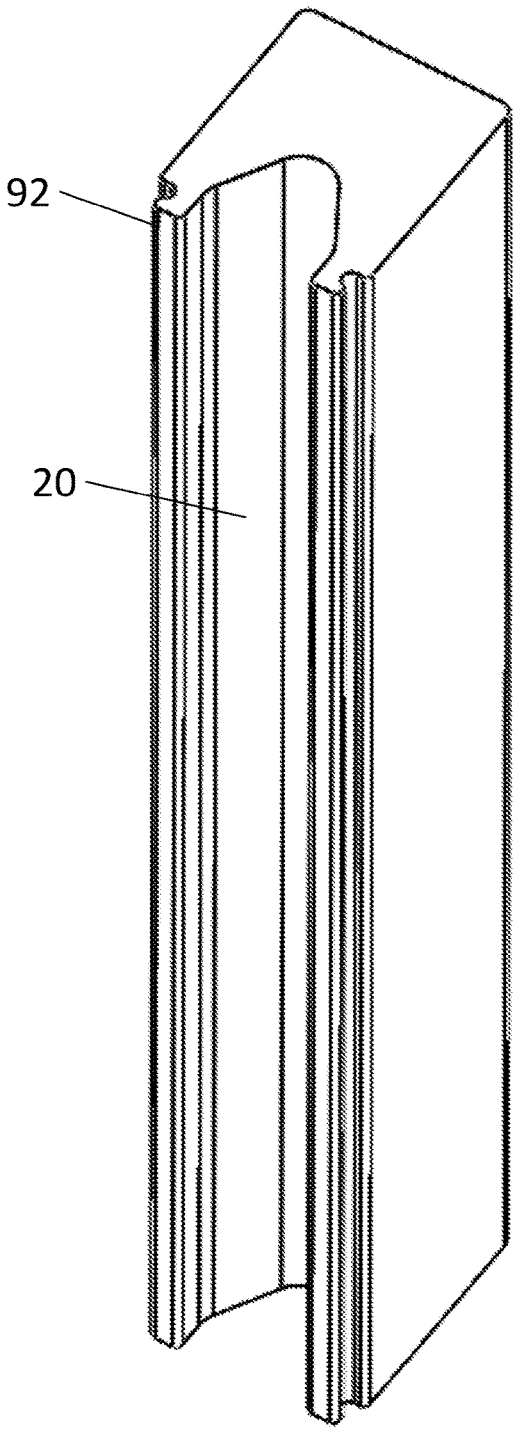
FIG. 18A is a front perspective view of one embodiment of the compact energetic-breaching apparatus.
Figure 18B:
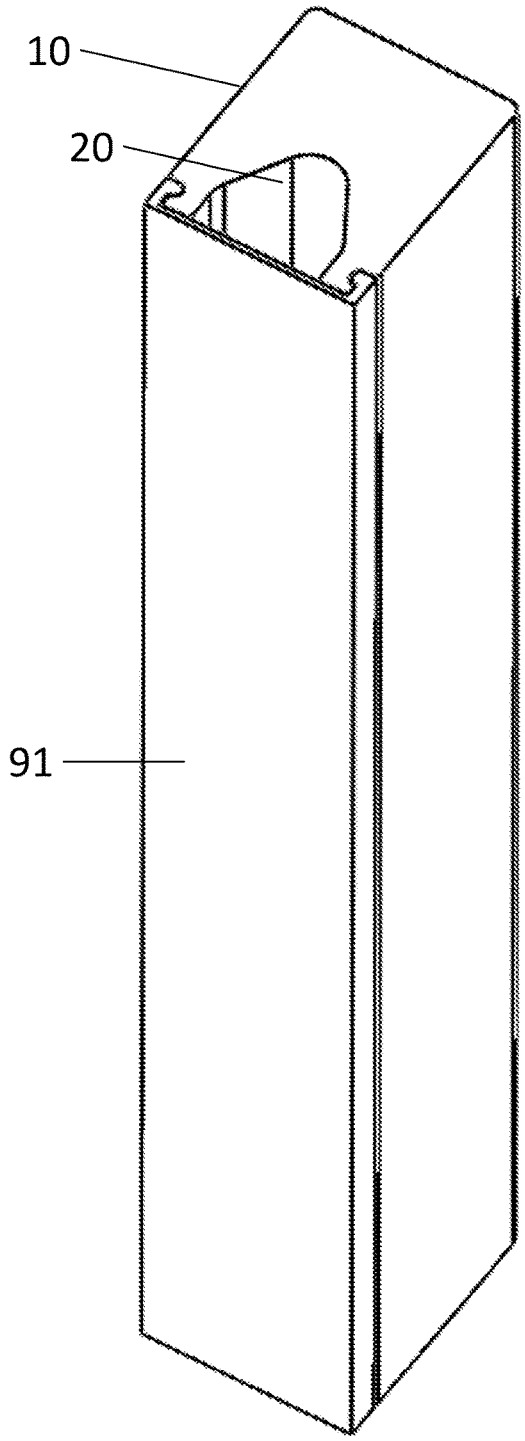
FIG. 18B is a front perspective view of the embodiment of the compact energetic-breaching apparatus of FIG. 18A showing an attachable cover.
Figure 19:
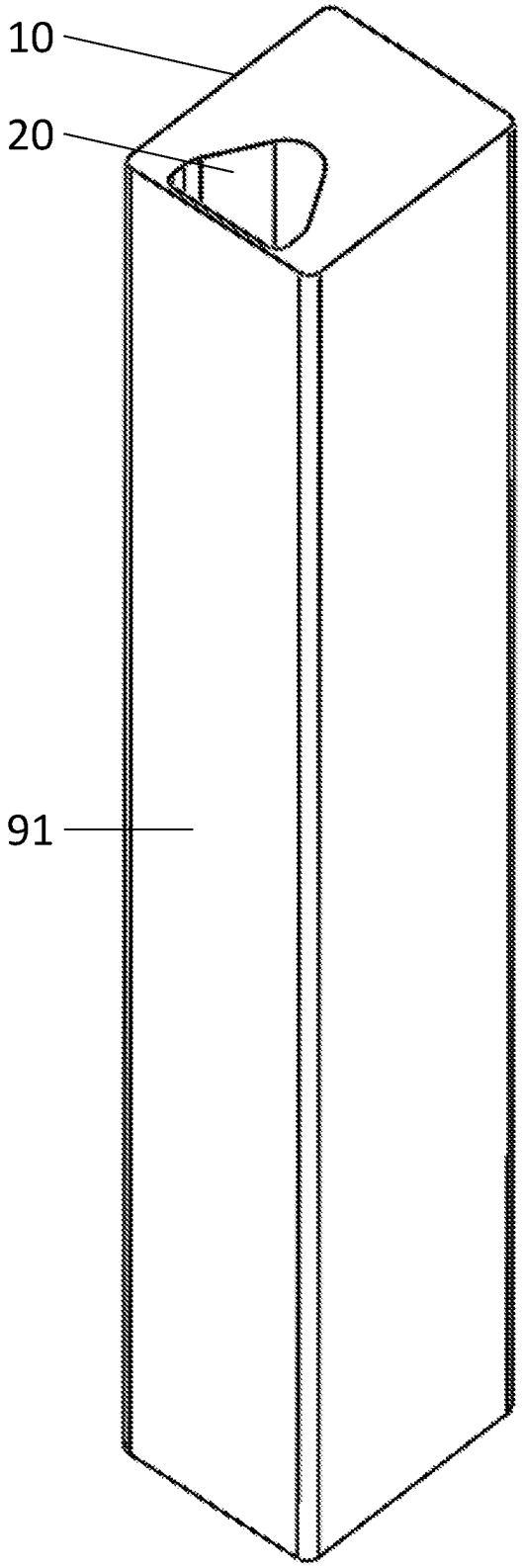
FIG. 19 is a front perspective view of one embodiment of the compact energetic-breaching apparatus.

The attachable cover 91 shown in FIG. 18 may also be used with virtually all of the other embodiments shown in FIGS. 1-20. For simplicity the attachable cover 91 is only shown in FIG. 18 using the same channel configuration as that shown in FIG. 16. In some embodiments, an attachable cover 91 may be slide-fit-type or snap-fit-type attachments, engaging some protrusion, edge, depression, or rails 92 inside the channel 20 (like that shown in FIG. 13) on the housing body 10 (like that shown in FIG. 18). Such an attachable cover 91 may also be formed as integral to the housing body 10 (like that shown in FIG. 19). In some embodiments, such an attachable cover 91 may help to retain energetic material. In some embodiments, an attachable cover 91 may house a push plate 90. In some embodiments, an attachable cover 91 may comprise an adhesive, magnets, or other means of attachment or fastening.

While the foregoing specification has described specific embodiments of this invention and many details have been put forth for the purpose of illustration or example, it will be apparent to one skilled in the art that the invention is susceptible to additional embodiments and that certain of the details described herein can be varied considerably without departing from the basic principles of the invention.

We claim:

1. A compact energetic-breaching apparatus comprising:

a one-piece, substantially hollow housing body comprised of a frangible material and having a top face and a bottom face; and a channel formed in the housing body configured to receive energetic material;

wherein the housing body is a right prism, and has a width, a depth, and a height;

wherein a tamping material substantially fills the housing body; and wherein the tamping material is a water-based or polymer-based gel.

2. The compact energetic-breaching apparatus of claim 1, further comprising an attachable cover.

3. The compact energetic-breaching apparatus of claim 1, wherein the channel extends from the top face to the bottom face.

4. The compact energetic-breaching apparatus of claim 1, wherein the channel comprises a first cross section profile across a first length and a second cross section profile across a second length, wherein the first cross section profile and second cross section profile are different.

5. The compact energetic-breaching apparatus of claim 4, wherein the first cross section profile is comprised of a priming pocket configured to receive a detonator.

6. The compact energetic-breaching apparatus of claim 4, wherein the channel further comprises a third cross section profile across a third length.

7. The compact energetic-breaching apparatus of claim 1, wherein the housing body has a wall thickness that is less than 5 mm.

8. The compact energetic-breaching apparatus of claim 1, wherein at least a portion of the channel has a curved cross section profile.

9. The compact energetic-breaching apparatus of claim 1, wherein the channel is positioned on an edge between a front face and a side face of the housing body.

10. The compact energetic-breaching apparatus of claim 1, wherein the housing body further comprises a channel lip protruding over the channel configured to retain energetic material positioned in the channel.

11. The compact energetic-breaching apparatus of claim 1, wherein the channel breaches the top and bottom faces of the housing body, but does not breach a front face, a back face, or a side face.

12. An energetic-breaching apparatus comprising:

a one-piece, substantially hollow housing body comprised of a frangible material and having a top face and a bottom face for containing a tamping material; and a channel formed in the housing body configured to receive energetic material, wherein the channel has a first cross section profile across a first channel length having a curved profile;

wherein the housing body is a right prism, and has a width, a depth, and a height; and wherein the tamping material substantially fills the housing body.

13. The energetic-breaching apparatus of claim 12, wherein the channel further comprises a second cross section profile across a second channel length, wherein the first cross section profile is different than the second cross section profile.

14. The energetic-breaching apparatus of claim 13, wherein the channel further comprises a third cross section profile across a third channel length, wherein the third channel length is different than the first and second cross section profiles.

15. The energetic-breaching apparatus of claim 14, wherein the third cross section profile is comprised of a booster pocket configured to receive at least one explosive booster.

16. The energetic-breaching apparatus of claim 12, wherein the first cross section profile is comprised of a priming pocket configured to receive a detonator.

17. The energetic-breaching apparatus of claim 12, wherein the housing body is made of circularly layered polymeric material.

* * * * *